US009206754B2

(12) United States Patent
Kato et al.

(10) Patent No.: US 9,206,754 B2
(45) Date of Patent: Dec. 8, 2015

(54) CONTROL DEVICE OF INTERNAL COMBUSTION ENGINE

(71) Applicants: Toshihiro Kato, Toyota (JP); Yoshifumi Matsuda, Toyota (JP); Yoshihisa Oda, Toyota (JP); Masashi Hakariya, Nagoya (JP); Masahide Okada, Anjo (JP); Isao Nakajima, Nisshin (JP); Hiroaki Tsuji, Miyoshi (JP); Tokiji Ito, Toyota (JP); Yuya Yoshikawa, Chiryu (JP)

(72) Inventors: Toshihiro Kato, Toyota (JP); Yoshifumi Matsuda, Toyota (JP); Yoshihisa Oda, Toyota (JP); Masashi Hakariya, Nagoya (JP); Masahide Okada, Anjo (JP); Isao Nakajima, Nisshin (JP); Hiroaki Tsuji, Miyoshi (JP); Tokiji Ito, Toyota (JP); Yuya Yoshikawa, Chiryu (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 14/204,507

(22) Filed: Mar. 11, 2014

(65) Prior Publication Data

US 2014/0290219 A1 Oct. 2, 2014

(30) Foreign Application Priority Data

Mar. 27, 2013 (JP) ..... 2013-067208

(51) Int. Cl.

| | |
|---|---|
| ***F01N 3/00*** | (2006.01) |
| ***F02D 41/14*** | (2006.01) |
| ***F02D 41/22*** | (2006.01) |
| ***F02D 41/30*** | (2006.01) |

(52) U.S. Cl.

CPC ..... *F02D 41/1441* (2013.01); *F02D 41/1486* (2013.01); *F02D 41/221* (2013.01); *F02D 41/3094* (2013.01); *F02D 41/1443* (2013.01)

(58) Field of Classification Search

CPC ..... F02D 41/1441; F02D 41/1486; F02D 41/221; F02D 41/3094; F02D 41/1443

USPC ..... 60/276, 278, 283, 285, 289; 123/299, 123/300; 701/103, 104, 105, 107

See application file for complete search history.

(56) References Cited

U.S. PATENT DOCUMENTS

| | | | | |
|---|---|---|---|---|
| 2009/0216429 | A1 * | 8/2009 | Yamashita et al. | 701/107 |
| 2012/0277979 | A1 | 11/2012 | Kato et al. | |
| 2012/0297866 | A1 * | 11/2012 | Tanaka et al. | 73/114.31 |
| 2013/0006506 | A1 | 1/2013 | Takada et al. | |
| 2013/0144510 | A1 | 6/2013 | Iwazaki et al. | |
| 2013/0226437 | A1 * | 8/2013 | Kato et al. | 701/104 |
| 2014/0290348 | A1 * | 10/2014 | Nakajima et al. | 73/114.75 |
| 2015/0075492 | A1 * | 3/2015 | Glugla et al. | 123/349 |

FOREIGN PATENT DOCUMENTS

| | | | |
|---|---|---|---|
| JP | 2009-057853 | A | 3/2009 |
| JP | 2009203880 | A | 9/2009 |

(Continued)

*Primary Examiner* — Jason Shanske
*Assistant Examiner* — Matthew T Largi
(74) *Attorney, Agent, or Firm* — Dinsmore & Shohl LLP

(57) ABSTRACT

A control device of an internal combustion engine according to the present invention has units configured to inject fuel at a first predetermined ratio from first and second fuel injection valves which are provided in each of cylinders to calculate a first value indicating a degree of variation in air-fuel ratios between the cylinders based on a output of the engine, and inject fuel at a second predetermined ratio therefrom to calculate a second value in the same manner. Furthermore, the control device has a unit configured to select one mode from modes relating to abnormality in the first fuel injection valve or the second fuel injection valve on the basis of the first and second values, and calculate a value indicating the degree of the variation in the air-fuel ratios between the cylinders, thereby calculating a fuel amount of the basis of them.

11 Claims, 17 Drawing Sheets

(56) References Cited

FOREIGN PATENT DOCUMENTS

| | | | |
|---|---|---|---|
| JP | 2012-017657 | A | 1/2012 |
| JP | 2012-097671 | A | 5/2012 |
| JP | 2012-172527 | A | 9/2012 |
| JP | 2012-233425 | A | 11/2012 |
| JP | 2013-011222 | A | 1/2013 |
| WO | 2011155073 | A1 | 12/2011 |

* cited by examiner

CONTROL DEVICE OF INTERNAL COMBUSTION ENGINE

CROSS-REFERENCES TO RELATED APPLICATIONS

This application claims the benefit of Japanese Patent Application No. 2013-067208, filed Mar. 27, 2013, which is hereby incorporated by reference herein in its entirety.

BACKGROUND OF THE INVENTION

1. Field of the Invention

The present invention relates to a control device of an internal combustion engine in which a plurality of fuel injection valves are provided in each of a plurality of cylinders.

2. Description of the Related Art

Generally, in an internal combustion engine provided with an exhaust gas purification system utilizing a catalyst, it is essential to control a mixing ratio between air and fuel in an air-fuel mixture burned in the internal combustion engine, that is, an air-fuel ratio, in order to purify, with high efficiency, harmful components in the exhaust gas by the catalyst. In order to control the air-fuel ratio mentioned above, the internal combustion engine is provided with sensors that generate outputs in accordance with an amount of oxygen in the exhaust gas on the upstream and downstream sides of a catalyst, that is, a catalyst purifying device of an exhaust passage, and an air-fuel ratio feedback control is executed so as to cause the air-fuel ratio to follow a target air-fuel ratio on the basis of the outputs. For example, an air-fuel ratio control (a main feedback control) is executed on the basis of an output of a so-called wide-area air-fuel ratio sensor which is provided in the upstream side of the catalyst, while performing correction on the basis of an output of a so-called oxygen sensor which is provided in the downstream side of the catalyst (carrying out a sub feedback control).

Generally, in the internal combustion engine mentioned above, since the air-fuel ratio control is normally carried out by using the same control amount with respect to all the cylinders, an actual air-fuel ratio can vary between the cylinders even if executing the air-fuel ratio control. In the case where a degree of the variation is small, the variation can be absorbed by the air-fuel ratio feedback control, and the harmful components in the exhaust gas can be purified by the catalyst, and thus the emission is not affected, and any particular problem is not generated. However, in the case where the air-fuel ratio between the cylinders vary greatly, for example, due to failure in a fuel injection system or a valve system of an intake valve in a certain cylinder of the cylinders, the emission is deteriorated and a problem is generated. Furthermore, in the case where the air-fuel ratio between the cylinders vary greatly as mentioned above, the air-fuel ratio sensor on the upstream side of the catalyst has a strong tendency of producing the same output as that when the air-fuel ratio is richer than the theoretical air-fuel ratio, due to influence of hydrogen component in the exhaust gas, and the air-fuel ratio tends to shift to a lean side on the basis of the air-fuel ratio control. Therefore, it is desirable to suppress the shift to the lean side mentioned above.

For example, a fuel injection amount control device of an internal combustion engine described in International Publication No. WO2011/155073 is provided with a configuration of performing feedback correction of an amount of fuel to be injected by a fuel injection valve so that an air-fuel ratio expressed by an output value of an air-fuel ratio sensor on an upstream side of a catalyst coincides with a target air-fuel ratio which is set to a theoretical air-fuel ratio. Furthermore, the device is provided with a configuration of obtaining an index value which becomes larger in response to increase in a difference between the cylinders of the air-fuel ratio of the air-fuel mixture supplied to each of combustion chambers, and correcting so as to increase an amount of a fuel so that the air-fuel ratio comes to an air-fuel ratio which is richer than the theoretical air-fuel ratio in response to increase in the obtained index value.

SUMMARY OF THE INVENTION

Incidentally, even in an internal combustion engine in which a plurality of fuel injection valves are provided in each of a plurality of cylinders, for example, the internal combustion engine having a fuel injection valve for intake passage injection (a port injector) and a fuel injection valve for in-cylinder injection (an in-cylinder injector) in relation to each of the cylinders, a degree of variation in the air-fuel ratios between the cylinders can be determined (refer to Japanese Patent Laid-Open No. 2012-233425). In the internal combustion engine mentioned above, the degree of the variation in the air-fuel ratios between the cylinders becomes larger in both the cases that only the port injector is out of order and only the in-cylinder injector is out of order. However, there exists a problem in that the fuel amount is corrected so as to be increased in accordance with the degree of the variation in the air-fuel ratios between the cylinders, such as the device in WO2011/155073 and the fuel having the corrected amount is shared and injected by the injectors. For example, if the amount of fuel is corrected so as to be increased simply in accordance with the degree of variation in the air-fuel ratios between the cylinder in the case where the injection rate of the in-cylinder injector is high, in spite of the fact that the degree of variation in the air-fuel ratios between the cylinders becomes large since only the port injector is out of order, the amount of the fuel is excessively corrected so as to be increased, and the emission is rather deteriorated.

Accordingly, the present invention has been made in consideration of the above circumstances, and an object of the present invention is to provide a control device of an internal combustion engine that has a plurality of fuel injection valves in each of a plurality of cylinders, wherein the control device appropriately carries out a fuel injection in the case where a degree of variation in an air-fuel ratios between cylinders is large.

According to an aspect of the present invention, there is provided a control device of an internal combustion engine, the control device including:

a fuel injection control unit configured to inject a predetermined fuel amount of fuel from a first fuel injection valve and a second fuel injection valve which are provided in each of a plurality of cylinders, by using an injection ratio which is set in accordance with an engine operation state;

a first value calculating unit configured to calculate a first value indicating a degree of variation in air-fuel ratios between the cylinders on the basis of a predetermined output of the internal combustion engine associated with the fuel injection from the first fuel injection valve and the second fuel injection valve by using a first predetermined injection ratio;

a second value calculating unit configured to calculate a second value indicating the degree of variation in the air-fuel ratios between the cylinders on the basis of a predetermined output of the internal combustion engine associated with the fuel injection from the first fuel injection valve and the second fuel injection valve by using a second predetermined injection ratio which is different from the first predetermined injection ratio;

a mode selection unit configured to select one mode from a plurality of modes including a first mode relating to abnormality in at least any one of a plurality of first fuel injection valves and a second mode relating to abnormality in at least any one of a plurality of second fuel injection valves, on the basis of the first value which is calculated by the first value calculating unit and the second value which is calculated by the second value calculating unit;

a variation value calculating unit configured to calculate a variation value indicating a variation degree in the air-fuel ratios between the cylinders on the basis of the first value which is calculated by the first value calculating unit and the second value which is calculated by the second value calculating unit; and a fuel amount calculating unit configured to calculate the predetermined fuel amount while performing correction on the basis of one mode which is selected by the mode selection unit and the variation value which is calculated by the variation value calculating unit so that the air-fuel ratio tracks the target air-fuel ratio in accordance with outputs of a catalyst upstream sensor and a catalyst downstream sensor which are provided on upstream and downstream sides of a catalyst in an exhaust passage and which respectively generate the outputs corresponding to an amount of oxygen in the exhaust gas.

Preferably, the fuel amount calculating unit determines a correction value on the basis of an injection ratio which is set in accordance with an engine operation state, depending on the selected mode in the case where the first mode or the second mode is selected by the mode selection unit, and calculates the predetermined fuel amount by using the correction value. Particularly, the fuel amount calculating unit preferably determines the correction value so that the air-fuel ratio has a richer air-fuel ratio than the target air-fuel ratio in line with an increase of the degree of variation in the air-fuel ratios between the cylinders on the basis of the variation value, and calculates the predetermined fuel amount by using the correction value.

Preferably, the fuel amount calculating unit corrects a sub feedback amount which is calculated on the basis of a difference between the output value of the catalyst downstream sensor and the predetermined target value, by using the correction value, and calculates the predetermined fuel amount on the basis of the corrected sub feedback amount. Alternatively, the fuel amount calculating unit preferably corrects the target air-fuel ratio by using the correction value, and calculates the predetermined fuel amount on the basis of the corrected target air-fuel ratio.

Further preferably, the fuel amount calculating unit determines the correction value on the basis of an engine operation state, and calculates the predetermined fuel amount by using the correction value. In this case, the fuel amount calculating unit preferably determines the correction value on the basis of at least one of an engine cooling water temperature and a time from an engine start, and calculates the predetermined fuel amount by using the correction value.

According to the present invention having the configuration mentioned above, one mode is selected from a plurality of modes including the first mode relating to the abnormality in at least any one of a plurality of first fuel injection valves and the second mode relating to the abnormality in at least any one of a plurality of second fuel injection valves, and the variation value indicating the variation degree of the air-fuel ratios between the cylinders is calculated. In addition, the predetermined fuel amount is calculated while performing correction on the basis of the selected one mode and the calculated variation value so that the air-fuel ratio tracks the target air-fuel ratio in accordance with the outputs of the catalyst upstream sensor and the catalyst downstream sensor. As a result, the predetermined fuel amount of fuel is injected by using the injection ratio which is set in accordance with the engine operation state from the first fuel injection valve and the second fuel injection valve which are provided to each of a plurality of cylinders. As mentioned above, since the fuel injection amount is set on the basis of the variation value and the selected mode, it becomes possible to preferably control the fuel injection from a plurality of fuel injection valves even if the degree of variation in the air-fuel ratios between the cylinders is large.

Further features of the present invention will become apparent from the following description of exemplary embodiments (with reference to the attached drawings).

DESCRIPTION OF THE EMBODIMENTS

Hereinafter, there will be described embodiments according to the present invention with reference to the accompanying drawings. First, there will be described a first embodiment.

Figure 1:
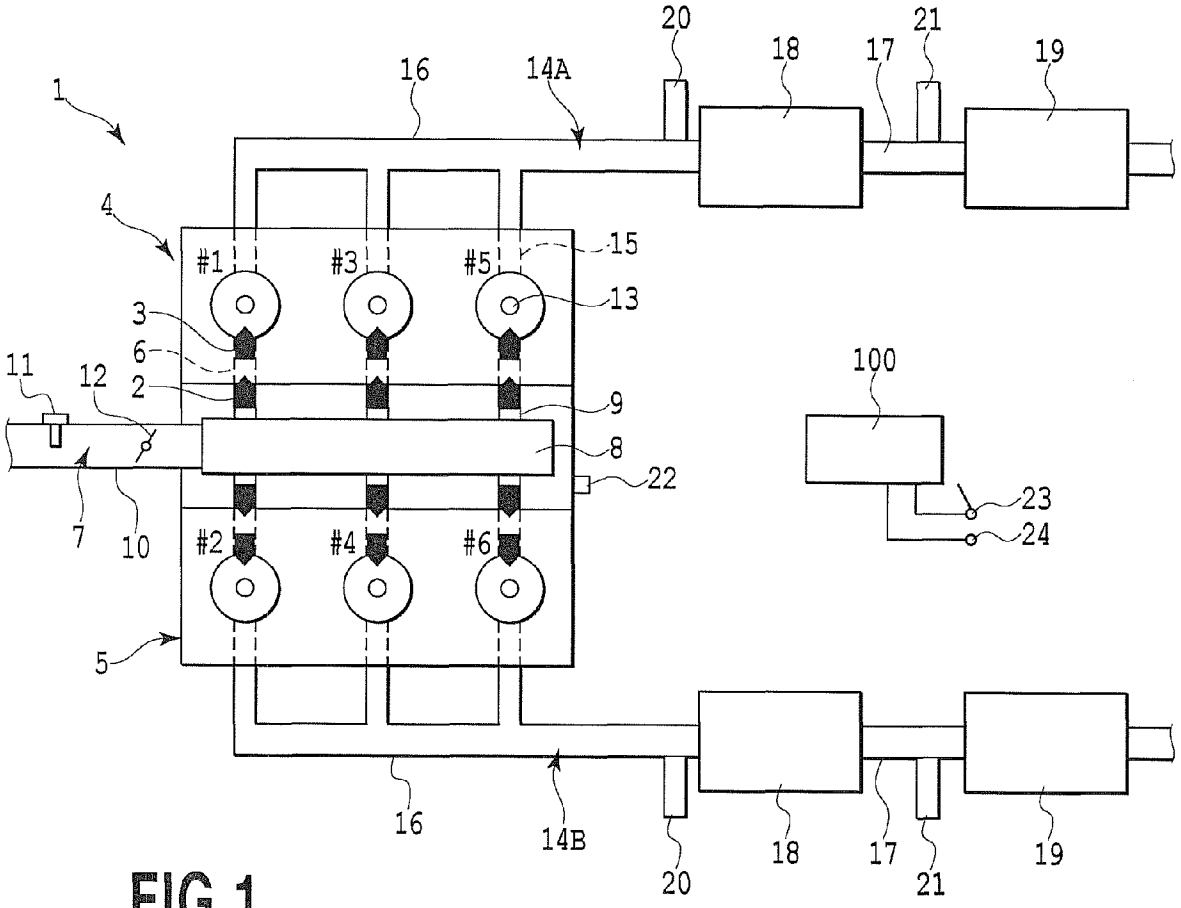
FIG. 1 is a schematic view of an internal combustion engine according to a first embodiment of the present invention.

FIG. 1 schematically shows an internal combustion engine according to the present first embodiment. An illustrated internal combustion engine (hereinafter, refer to as an engine) 1 is a V-type six-cylinder duel injection-type gasoline engine. Each of cylinders #1 to #6 is provided with a fuel injection valve for intake passage injection (a port injector) 2 and a fuel injection valve for cylinder injection (a in-cylinder injector) 3. The engine 1 has a first bank 4 and a second bank 5, the first bank 4 is provided with odd-numbered cylinders, that is, the #1, #3 and #5 cylinders, and the second bank 5 is provided with even-numbered cylinders, that is, the #2, #4 and #6 cylinders.

The port injector 2 injects fuel toward an intake passage, particularly toward an inner side of an intake port 6, of the corresponding cylinder, so as to achieve so-called homogeneous combustion. Hereinafter, the port injection is also referred to as "PFI". On the other hand, the in-cylinder injector 3 directly injects the fuel toward an inner side of the corresponding cylinder (an inner side of a combustion chamber) so as to achieve so-called stratified-charge combustion. Hereinafter, the in-cylinder injector is also referred to as "DI".

An intake passage 7 for introducing an intake air is generally formed by a surge tank 8 serving as a collecting portion, a plurality of intake manifolds 9 which connect the intake ports 6 in the respective cylinders and the surge tank 8, and an intake pipe 10 on an upstream side of the surge tank 8, in addition to the intake ports 6. The intake pipe 10 is provided with an air flow meter 11 and an electronically controlled throttle valve 12 in this order from the upstream side. The air flow meter 11 outputs a signal having a magnitude corresponding to an intake flow rate. Each of the cylinders is provided with an ignition plug 13 for igniting air-fuel mixture within the cylinder.

In an exhaust passage for discharging exhaust gas, in the present embodiment, a first exhaust passage 14A in relation to the first bank 4 and a second exhaust passage 14B in relation to the second bank 5 are installed as independent systems. That is, two exhaust systems are provided independently for each bank. Since the exhaust systems have the same configuration in both banks, a description will be given only of the first bank 4, and a description of the second bank 5 will be omitted by attaching the same reference numerals to the drawing.

The first exhaust passage 14A is generally formed by exhaust ports 15 of the respective cylinders #1, #3 and #5, an exhaust manifold 16 which collects the exhaust gas in the exhaust ports 15, and an exhaust pipe 17 which connects to a downstream end of the exhaust manifold 16. In addition, an upstream side and a downstream side of the exhaust pipe 17 are respectively provided with catalysts formed of three-way catalysts, that is, an upstream catalyst (an upstream catalyst-purifying device) 18 and a downstream catalyst (a downstream catalyst-purifying device) 19 in series. An upstream side and a downstream side of the upstream catalyst 18 are respectively provided with sensors 20 and 21 each of which generates an output corresponding to an amount of oxygen (an oxygen concentration or an oxygen partial pressure) in the exhaust gas (which outputs signals). The sensors 20 and 21 are, in short, sensors for detecting an air-fuel ratio, that is, air-fuel ratio sensors, and are respectively referred to as a catalyst upstream sensor 20 and a catalyst downstream sensor 21. As mentioned above, the single catalyst upstream sensor 20 is installed in the collecting portion of the exhaust passage in relation to the single bank. Particularly, the catalyst upstream sensor 20 is independently installed in the first exhaust passage 14A in relation to the first bank 4, and in the second exhaust passage 14B in relation to the second bank 5.

The port injector 2, the in-cylinder injector 3, the throttle valve 12, the ignition plug 13 and the like mentioned above are electrically connected to an electronic control unit (hereinafter, refer to as ECU) 100 serving as a control device. Meanwhile, in order to be easily viewable, lines indicating the connections are omitted in FIG. 1. The ECU 100 includes a CPU serving as a processor, a memory device containing a ROM and a RAM, input and output ports and the like which are not illustrated. Furthermore, to the ECU 100, there are electrically connected, via an A/D converter not shown and the like, a crank angle sensor 22 for detecting a crank angle of the engine 1, an accelerator position sensor 23 for detecting an accelerator position, a water temperature sensor 24 for detecting a temperature of a cooling water of the engine 1, and the other various sensors, in addition to the air flow meter 11, the catalyst upstream sensor 20 and the catalyst downstream sensor 21 mentioned above (a plurality of lines indicating connections are not shown in the drawing). The ECU 100 controls the port injector 2, the in-cylinder injector 3, the throttle valve 12, the ignition plug 13 and the like so that a desired output can be obtained on the basis of outputs of the various sensors, that is, detection values, and controls a fuel injection amount, a fuel injection timing, a throttle position, an ignition timing and the like. Moreover, the ECU 100 detects the crank angle of the engine 1 on the basis of the output of the crank angle sensor 22, and calculates a rotating speed of the engine. Here, revolutions per minute (rpm) is used as the rotating speed of the engine. As mentioned above, the crank angle sensor 22 is here used as an engine rotating speed sensor.

Meanwhile, the ECU 100 takes on the respective functions of a fuel injection control unit, an intake air control unit, and an ignition control unit, as can be understood from the description mentioned above, and also takes on the function of an air-fuel ratio control unit, as will be described below. In addition, the ECU 100 also take on the respective functions of a first value calculating unit, a second value calculating unit, a mode selection unit, a variation value calculating unit and a fuel amount calculating unit. These units are associated with each other. Meanwhile, the fuel amount calculating unit can be included in the fuel injection control unit, and the fuel amount calculating unit and the fuel injection control unit are included in the air-fuel ratio control unit.

Figure 2:
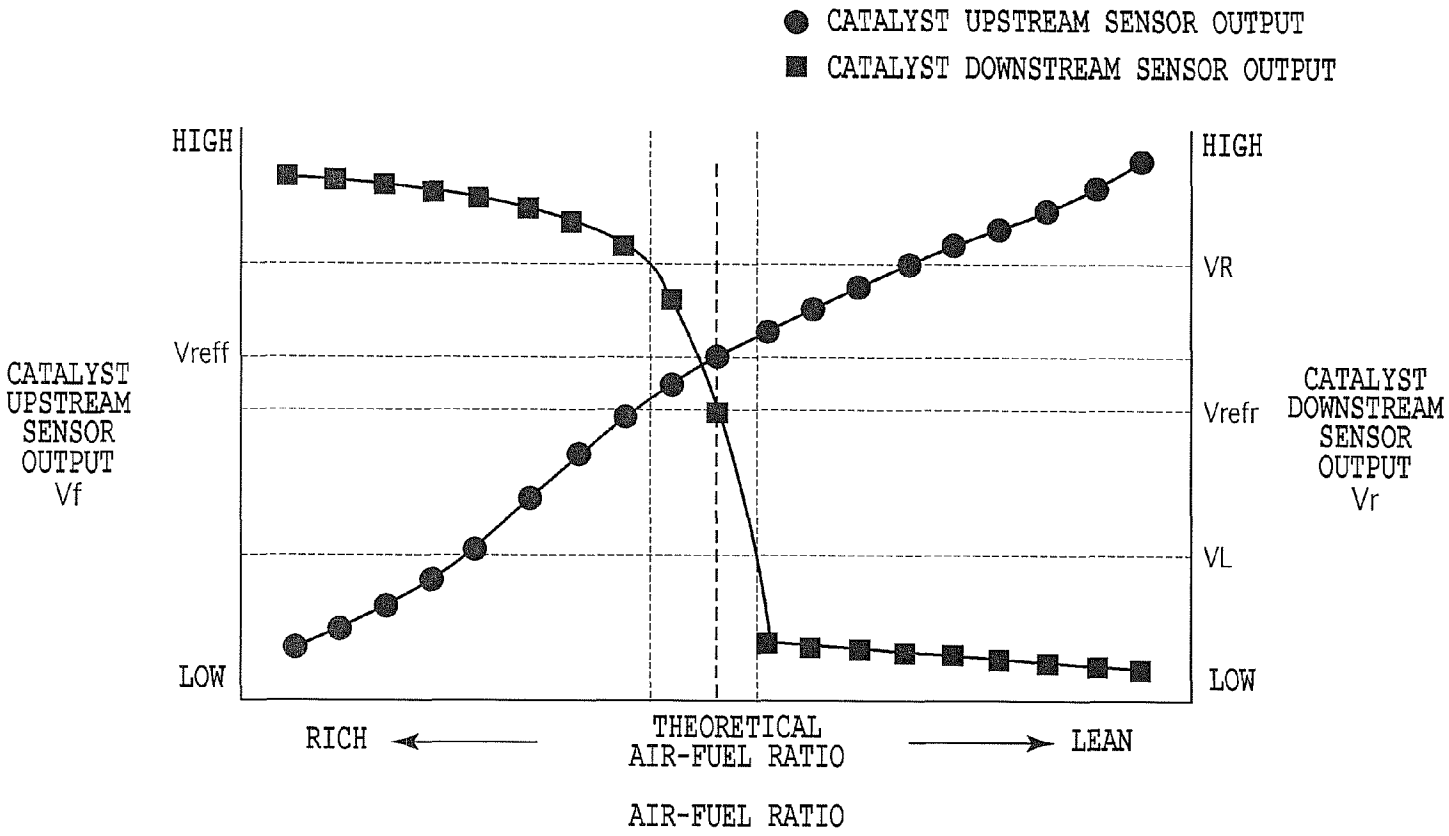
FIG. 2 is a graph showing output characteristics of a catalyst upstream sensor and a catalyst downstream sensor.

The catalyst upstream sensor 20 is a so-called wide area air-fuel ratio sensor, and can continuously detect an air-fuel ratio over a comparatively wide range. FIG. 2 shows output characteristics of the catalyst upstream sensor 20. As shown, the catalyst upstream sensor 20 outputs a voltage signal Vf having a magnitude which is in proportion to an oxygen concentration of the exhaust gas, corresponding to an air-fuel ratio of the burned mixture. The output voltage in the case where the air-fuel ratio is a theoretical air-fuel ratio (stoichiometry, for example, A/F=14.6) is Vreff (for example, about 3.3 V).

On the other hand, the catalyst downstream sensor 21 is a so-called oxygen ($O_2$) sensor, and has characteristics in which an output value rapidly varies on the boundary of the stoichiometry. FIG. 2 shows output characteristics of the catalyst downstream sensor 21. The catalyst downstream sensor 21 outputs a signal in accordance with an oxygen concentration of the exhaust gas, corresponding to an air-fuel ratio of the burned mixture. As shown, an output voltage in the case where the air-fuel ratio is stoichiometric, that is, a stoichiometry-corresponding value is Vrefr (for example, 0.45 V). The output voltage of the catalyst downstream sensor 21 varies within a predetermined range (for example, 0 to 1 (V)). In the case where the air-fuel ratio is leaner than being stoichiometric, the output voltage of the catalyst downstream sensor becomes lower than a stoichiometry-corresponding value Vrefr, and in the case where the air-fuel ratio is richer than being stoichiometric, the output voltage of the catalyst downstream sensor becomes higher than the stoichiometry-corresponding value Vrefr.

The upstream catalyst 18 and the downstream catalyst 19 simultaneously purify NOx, HC and CO as harmful components in the exhaust gas in the case where the air-fuel ratios A/F of the exhaust gas flowing into them are close to being stoichiometric. A width (window) of the air-fuel ratio which can purify these three elements simultaneously with a high efficiency is comparatively narrow.

Accordingly, in a normal operation time of the engine 1, an air-fuel ratio control (a stoichiometry control) is executed by the ECU 100, the air-fuel ratio control being executed for controlling the detected air-fuel ratio of the exhaust gas flowing into the upstream catalyst 18 to the vicinity of the stoichiometry. The air-fuel ratio control includes a main air-fuel ratio control (a main feedback control) which feedback controls the air-fuel ratio (specifically the fuel injection amount) of the air-fuel mixture so that the air-fuel ratio detected by the catalyst upstream sensor 20 becomes stoichiometric, being a predetermined target air-fuel ratio, and an auxiliary air-fuel ratio control (a sub feedback control) which feedback controls the air-fuel ratio (specifically the fuel injection amount) of the air-fuel mixture so that the air-fuel ratio detected by the catalyst downstream sensor 21 becomes stoichiometric. Specifically, in the main feedback control, in order to cause the current air-fuel ratio detected on the basis of the output of the catalyst upstream sensor 20 to follow the predetermined target air-fuel ratio, there is executed a control of computing a correction value and of regulating the fuel injection amount from the port injector 2 and the cylinder injector 3 on the basis of the correction value. In addition, furthermore, in the sub feedback control, there is executed a control of computing the other correction value on the basis of the output of the catalyst downstream sensor 21, and of correcting the correction value obtained by the main feedback control. However, in the present embodiment, the predetermined target air-fuel ratio, that is, a reference value of the air-fuel ratio is stoichiometric, and the fuel injection amount corresponding to the stoichiometry is a reference of the fuel injection amount. The reference value of the air-fuel ratio and the reference value of the fuel injection amount can be set to the other values. Meanwhile, in the air-fuel ratio control, the same control amount is uniformly used in each of the cylinders.

The air-fuel ratio control mentioned above is carried out every bank. That is, the air-fuel ratio control of the #1, #3 and #5 cylinders belonging to the first bank 4 is carried out on the basis of the outputs of the catalyst upstream sensor 20 and the catalyst downstream sensor 21 in a side of the first bank 4. On the other hand, the air-fuel ratio control of the #2, #4 and #6 cylinders belonging to the second bank 5 is carried out on the basis of the outputs of the catalyst upstream sensor 20 and the catalyst downstream sensor 21 in a side of the second bank 5.

Furthermore, there is carries out a sharing injection in which the total fuel injection amount injected during one injection cycle in one cylinder is shared by the port injector 2 and the in-cylinder injector 3 in accordance with predetermined injection rates $\alpha$ and $\beta$. At this time, the ECU 100 sets an amount of the fuel injected from the port injector 2 (a port injection amount) and an amount of the fuel injected from the in-cylinder injector 3 (a in-cylinder injection amount) in accordance with the injection rates $\alpha$ and $\beta$, and performs energization control of the respective injectors 2 and 3 in accordance with the fuel amounts. Here, the injection rate $\alpha$ or $\beta$ is a percentage value of the port injection amount or the in-cylinder injection amount to the total fuel injection amount, and has a value between 0 and 100 ($\beta=100-\alpha$). In the case where the total fuel injection amount is set to Qt, a port injection amount Qp is expressed by $\alpha\times Qt/100$, a in-cylinder injection amount Qd is expressed by $\beta\times Qt/100$, and an injection ratio of the both is $Qp:Qd=\alpha:\beta$. As mentioned above, the injection rates $\alpha$ and $\beta$ are values defining the injection sharing ratio between the port injector 2 and the in-cylinder injector 3, or between the port injection amount Qp and the in-cylinder injection amount Qd. The total fuel injection amount is set by the ECU 100 on the basis of an engine operation state and the like as described below.

Figure 3:
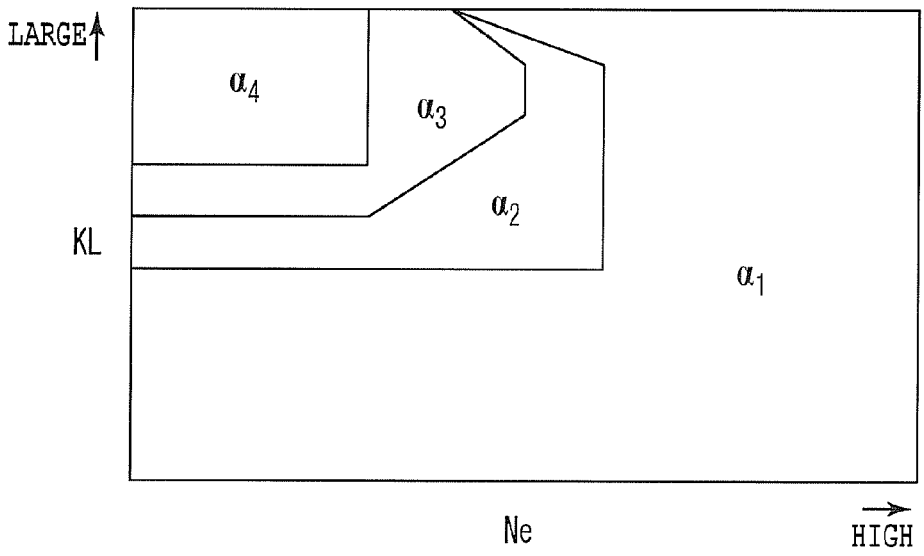
FIG. 3 is a view showing an injection ratio of a fuel in a port injector.

FIG. 3 shows mapped data for setting the injection rate $\alpha$. As shown, the injection rate $\alpha$ changes from $\alpha1$ to $\alpha4$ in accordance with the engine operation state, that is, each of areas defined by an engine rotating speed Ne and an engine load KL. For example, $\alpha1=0$, $\alpha2=35$, $\alpha3=50$ and $\alpha4=70$, but these values and area separation can be optionally changed. In the example, a rate of the port injection amount is increased as approaching a low rotation and high load side. Furthermore, in the sharing injection in the area of $\alpha=\alpha1$ (=0), the fuel is supplied only by the in-cylinder injection ($\beta=100$). The injection rates $\alpha$ and $\beta$ makes use of the same value with respect to each of the cylinders in both the banks. That is, the injection rates $\alpha$ and $\beta$ are not set every bank.

It is assumed, for example, that the injection in a certain cylinder of all the cylinders is out of order, and the variation (imbalance) of the air-fuel ratio is generated between the cylinders. For example, there is a case where the fuel injection amount in the #1 cylinder becomes larger than each of the fuel injection amounts in the other #2 to #6 cylinders, and the air-fuel ratio of the #1 cylinder is deviated to a much richer side than the air-fuel ratios of the other #2 to #6 cylinders. At this time, if the comparatively large correction amount is applied on the basis of the air-fuel ratio mentioned above to the first bank 4 including the #1 cylinder, there is a case where the air-fuel ratio of the total gas can be stoichiometrically controlled. However, in view of each of the cylinders, the #1 cylinder is richer than being stoichiometric, the #3 and #5 cylinders are leaner rather than being stoichiometric, and the cylinders only becomes stoichiometric as a whole balance. Accordingly, it is apparent that this case is not preferable in terms of the emission.

Furthermore, the fuel supplied to the combustion chamber is a compound of carbon and hydrogen. Therefore, in the case where the air-fuel ratio of the air-fuel mixture subjected to combustion is the air-fuel ratio which is richer side than being stoichiometric, a probability that an unburned substance as an intermediate product such as HC, CO and $H_2$ produced is combined with oxygen, that is, burned to be oxidized becomes rapidly small, as the air-fuel ratio approaches the rich side. As a result, the closer to the rich side the air-fuel ratio is, the more the amount of the unburned substance discharged from the combustion chamber is increased. This is also applied in the same manner to the cylinder (the rich imbalance cylinder) in which the fuel injection amount becomes larger than that in each of the other normal cylinders as mentioned above, and is shown in FIG. 4.

Figure 4:
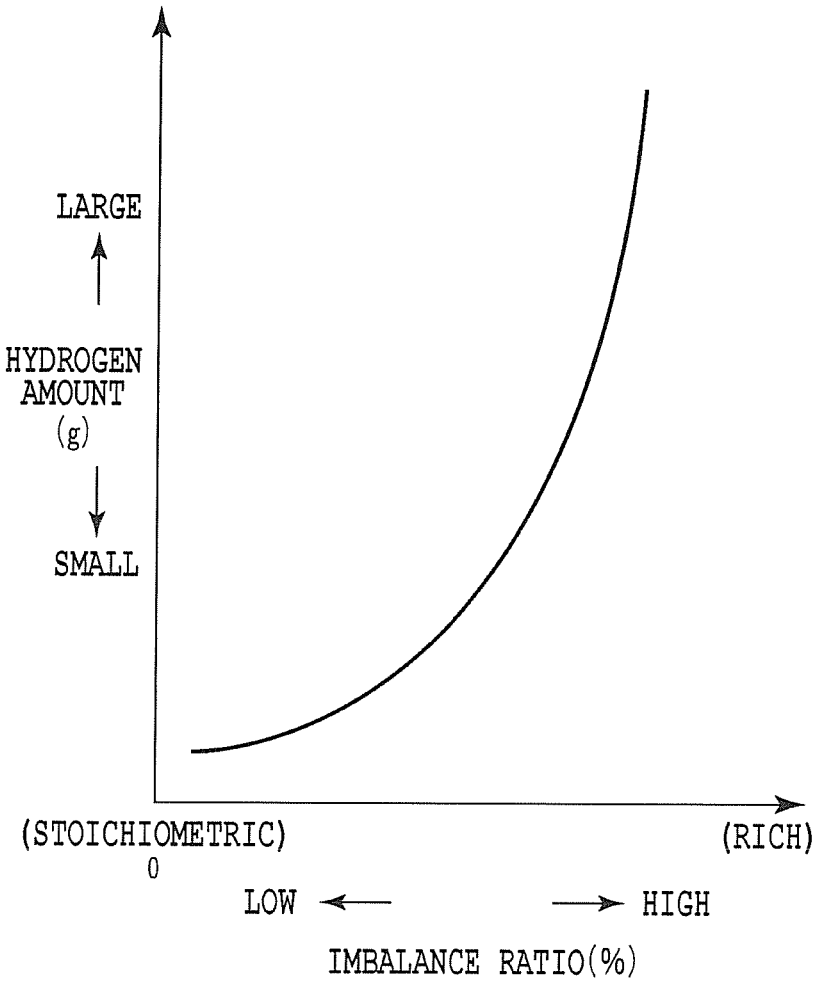
FIG. 4 is a graph showing a relationship between an imbalance ratio and an amount of hydrogen discharged to an exhaust passage.

FIG. 4 is a graph showing a change of a hydrogen discharging amount relative to a rich side air-fuel ratio or an imbalance ratio. The imbalance ratio (%) is a parameter indicating a variation degree of the air-fuel ratios between the cylinders, that is, an imbalance degree. That is, the imbalance ratio is a value indicating what rate the fuel injection amount of the cylinder generating the fuel injection amount deviation (the imbalance cylinder) is deviated from the fuel injection amount of the cylinder not generating the fuel injection deviation (the balance cylinder), in the case where only one cylinder generates a fuel injection amount deviation in all the cylinders. The imbalance ratio IB is expressed by IB=(Qib−Qs)/Qs×100, in which IB is the imbalance ratio, Qib is the fuel injection amount of the balance cylinder, and Qs is the fuel injection amount of the balance cylinder, that is, the reference fuel injection amount. The greater the imbalance ratio IB or an absolute value thereof is, the greater the fuel injection amount deviation of the imbalance cylinder relative to the balance cylinder is, and the greater the degree of the variation in the air-fuel ratios between the cylinders is. Therefore, it is known from FIG. 4 that the greater the degree of the variation in the air-fuel ratio between the cylinders is, the larger the hydrogen discharging amount becomes.

On the other hand, the catalyst upstream sensor 20 which is the air-fuel ratio sensor is generally provided with a diffusion resistance layer, and generates an output in response to an amount of oxygen passing through the diffusion resistance layer and reaching an exhaust gas-side electrode layer (a detecting element surface) of the catalyst upstream sensor 20 (an oxygen concentration or an oxygen partial pressure). However, the output of the catalyst upstream sensor 20 further corresponds to an amount (a concentration or a partial pressure) of the unburned substance passing through the diffusion resistance layer.

The hydrogen is a smaller molecule than HC and CO. Therefore, the hydrogen easily diffuses the diffusion resistance layer of the catalyst upstream sensor 20 in comparison with the other unburned substance. That is, the preferential hydrogen diffusion is generated in the diffusion resistance layer.

In the case where the degree of the variation in the air-fuel ratios between the cylinders becomes larger, the output of the catalyst upstream sensor 20 corresponds to the air-fuel ratio on the richer side than a true air-fuel ratio, due to the preferential hydrogen diffusion. Accordingly, since the air-fuel ratio closer to the richer side than the true air-fuel ratio is detected on the basis of the output of the catalyst upstream sensor 20, the greater correction on the lean side is carried out by the air-fuel ratio feedback control, in comparison with the case where the variation does not exist in the air-fuel ratios between the cylinders or the variation hardly exists.

This tendency is applied to the case where the fuel injection amount of the imbalance cylinder is smaller than the fuel injection amount of the balance cylinder as well as the case where the fuel injection amount of the imbalance cylinder is more than the fuel injection amount of the balance cylinder. In the case where the fuel injection amount of the imbalance cylinder is smaller than the fuel injection amount of the balance cylinder, the fuel injection amount of each of the other balance cylinders is increased by the air-fuel ratio feedback control, in such a manner as to make up for a shortfall of the fuel injection amount in the imbalance cylinder. Therefore, much hydrogen is discharged from the balance cylinder in comparison with the case where the variation in the air-fuel ratios between the cylinders does not exist or hardly exists. Due to the hydrogen, the catalyst upstream sensor 20 enhances the tendency of generating the output corresponding to the air-fuel ratio closer to the rich side than the true air-fuel ratio.

Consequently, as will be in detail mentioned later, there is carried out the fuel injection control or the air-fuel ratio control of investigating the degree of the variation in the air-fuel ratios between the cylinders and of carrying out an enriching correction so as to prevent the transfer to the lean side with the increase of the degree.

Furthermore, since the engine 1 is provided with the port injector 2 and the in-cylinder injector 3 every cylinder, the enriching correction is carried out on the basis of which of the injectors the variation in the air-fuel ratios between the cylinders is caused by. For example, if the correction for increasing the fuel amount, that is, the enriching correction is carried out in response to the degree of the variation in the air-fuel ratios between the cylinders in the case where the injection rate of the in-cylinder injector 3 is high in spite of the fact that the abnormality exists only in the port injector 2 and the degree of the variation in the air-fuel ratios between the cylinders becomes larger, the fuel becomes excessive. This can be easily understood by taking into consideration the engine operation state in which the injection rate $\alpha$ is set to $\alpha 1$ (=0). In this case, since the total fuel is injected only from the in-cylinder injector 3, it is not necessary to substantially take into consideration the degree of the variation in the air-fuel ratios between the cylinders due to the abnormality of the port injector 2.

Hereinafter, there will be described the air-fuel ratio control, that is, the fuel injection control according to the present first embodiment on the basis of the degree of the variation in the air-fuel ratios between the cylinders, and its cause. First, there will be described the detection of the degree of the variation in the air-fuel ratios between the cylinders in the engine 1.

Figure 5:
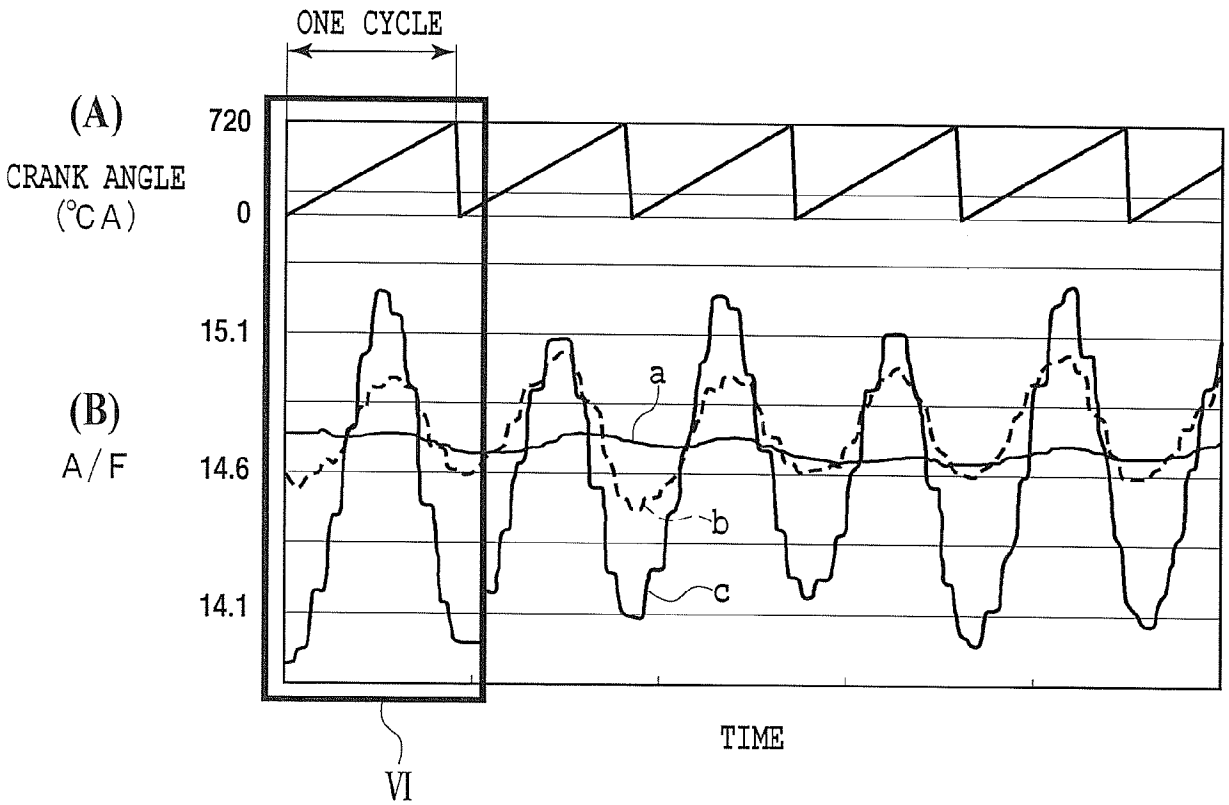
FIG. 5 is a time chart showing a fluctuation of an air-fuel ratio sensor output.

FIG. 5 shows a fluctuation of an air-fuel ratio sensor output in an in-line four-cylinder engine which is different from the engine 1 according to the present embodiment. As shown, an exhaust air-fuel ratio A/F detected on the basis of the output of the air-fuel ratio sensor tends to periodically fluctuate while setting an engine cycle (=720 degrees CA) to one period. In addition, in the case where the variation in the air-fuel ratios between the cylinders is generated, the fluctuation becomes greater in one engine cycle. Air-fuel ratio diagrams a, b and c in (B) respectively show the case where the variation does not exist, the case where only one cylinder forms the rich deviation with 20% imbalance ratio, and the case where only one cylinder forms the rich deviation with 50% imbalance ratio. As shown, the greater the variation degree is, the greater an amplitude of the air-fuel ratio fluctuation is. Even in the V-type six-cylinder engine like the present embodiment, the same tendency exists in the single bank.

As can be understood from the description mentioned above, the greater the variation degree in the air-fuel ratios between the cylinders is, the greater the fluctuation of the output of the catalyst upstream sensor 20 that is the air-fuel ratio sensor is. Accordingly, it is possible to detect the degree of the variation on the basis of the output fluctuation.

Here, the variation in the air-fuel ratios between the cylinders includes a rich deviation in which the fuel injection amount of one cylinder is deviated to the rich side (an excessive side), and a lean deviation in which the fuel injection amount of one cylinder is deviated to the lean side (a short side). However, the present embodiment widely detects the variation in the air-fuel ratios between the cylinders without distinguishing between the rich deviation and the lean deviation.

The variation mentioned above is detected by calculating an air-fuel ratio fluctuation parameter which is a parameter correlating with a fluctuation degree of the air-fuel ratio sensor output, and by comparing the air-fuel ratio fluctuation parameter determined for evaluation, with a predetermined determination value. Meanwhile, the predetermined determination value is a threshold value for determining whether or not the degree of the variation in the air-fuel ratios between the cylinders is great enough to be non-negligible, that is, the degree should be determined to be abnormal. The detection here is carried out every bank by using the output of the catalyst upstream sensor 20 which is the corresponding air-fuel ratio sensor.

Figure 6:
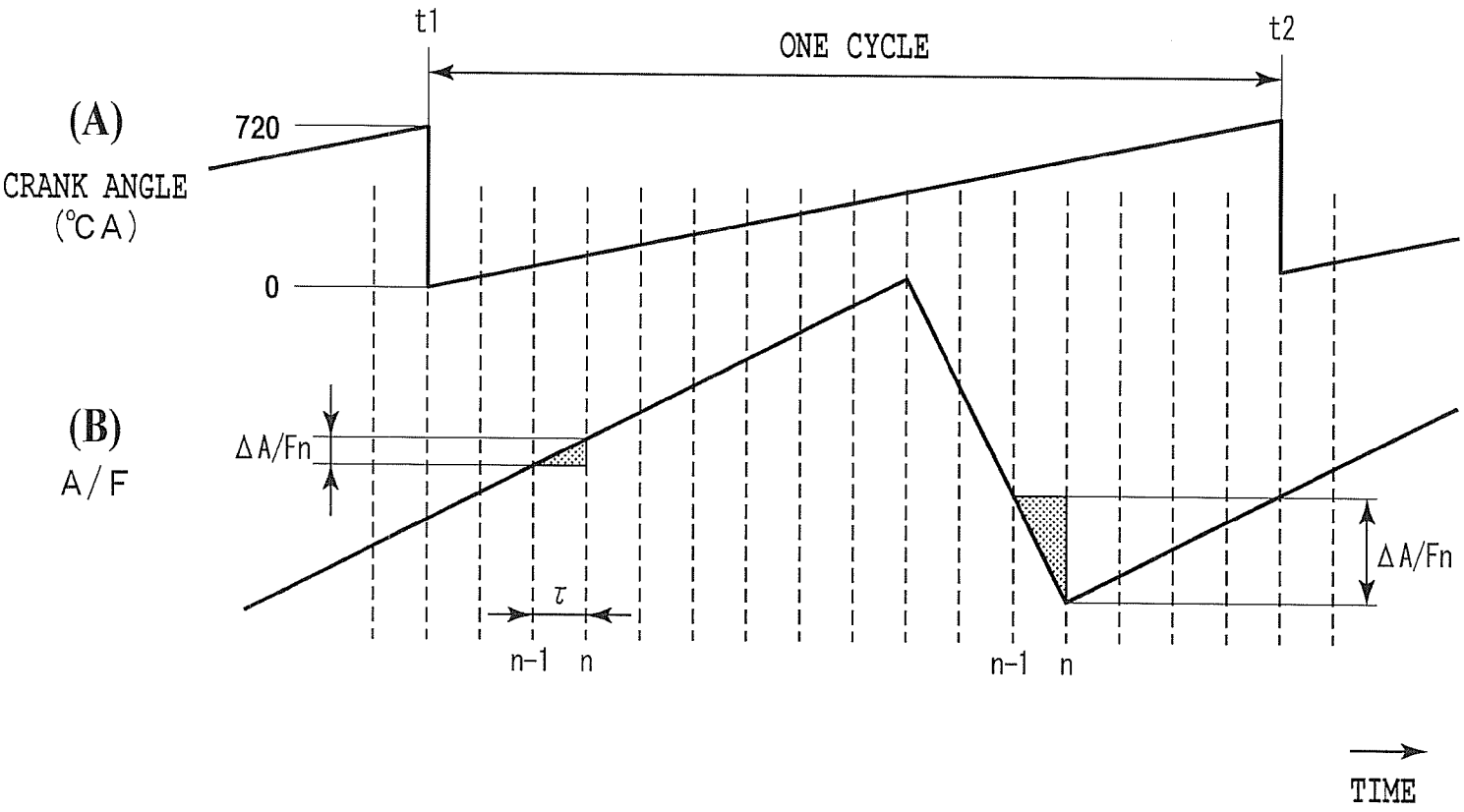
FIG. 6 is an enlarged view corresponding to a portion VI in FIG. 5.

Hereinafter, there will be described a method of calculating the air-fuel ratio fluctuation parameter. FIG. 6 is an enlarged view corresponding to a portion VI in FIG. 5, and particularly shows a fluctuation of the catalyst upstream sensor output in one engine cycle. The catalyst upstream sensor output employs a value obtained by converting an output voltage Vf of the catalyst upstream sensor 20 into an air-fuel ratio A/F. Meanwhile, it is also possible to directly employ the output voltage Vf of the catalyst upstream sensor 20.

As shown in FIG. 6(B), the ECU 100 acquires a value of an output A/F of the catalyst upstream sensor 20 every predetermined sampling period $\tau$ (unit time, for example, 4 ms) in one engine cycle. Furthermore, a difference $\Delta A/Fn$ is determined by the following formula (1), the difference $\Delta A/Fn$ being a difference between a value A/Fn which is acquired at this time timing (a second timing) and a value A/Fn−1 which is acquired at the preceding timing (a first timing). The difference $\Delta A/Fn$ can be reworded as a differential value or an inclination in this time timing.

$$\Delta A/Fn = A/Fn - A/Fn-1 \quad (1)$$

Most simply, the difference $\Delta A/Fn$ or a magnitude (an absolute value) thereof expresses the fluctuation of the catalyst upstream sensor output. The greater the fluctuation degree becomes, the greater the inclination of the air-fuel ratio diagram becomes, and thus the absolute value $|\Delta A/Fn|$ of the difference becomes larger. Therefore, the difference $\Delta A/Fn$ or the magnitude thereof in a predetermined one timing can be set to the air-fuel ratio fluctuation parameter.

In the present embodiment, the absolute value $|\Delta A/F|$ of the difference $\Delta A/F$ is used, and an average value of a plurality of absolute values $|\Delta A/Fn|$ of the differences is set to the air-fuel ratio fluctuation parameter for enhancing a precision. In the present embodiment, the average value of the absolute values $|\Delta A/Fn|$ of the differences in one engine cycle is obtained by determining the absolute values $|\Delta A/Fn|$ of the differences relating to the respective timings in one engine cycle, integrating them, and dividing the final integrated value by a sampling number N. Furthermore, an average value of the absolute values $|\Delta A/Fn|$ of the differences in M engine cycles is obtained by integrating the average values of the absolute values $|\Delta A/Fn|$ of the differences for the M engine cycles (for example, M=100), and dividing the final integrated values by a cycling number M. The final average obtained as mentioned above is set to the air-fuel ratio fluctuation parameter, and is expressed below as "X".

The greater the fluctuation degree of the catalyst upstream sensor output is, the greater the air-fuel ratio fluctuation parameter X becomes. Therefore, the air-fuel ratio fluctuation parameter X equal to or more than a predetermined determination value is determined to be abnormal, and the air-fuel ratio fluctuation parameter X smaller than the predetermined determination value is determined to be not abnormal, that is, normal. Meanwhile, according to a cylinder determination function of the ECU 100, it is possible to associate the ignition cylinder with the corresponding air-fuel ratio fluctuation parameter X.

Since there is the case where the catalyst upstream sensor output A/F is increased and the case where the catalyst upstream sensor output A/F is decreased, the difference $\Delta A/Fn$ (=A/Fn−A/Fn−1) or the average value thereof is obtained only in one of these cases, and can be set to the fluctuation parameter. Particularly, in the case where only one cylinder is deviated to the rich, the output of the catalyst upstream sensor 20 rapidly changes to the rich side (that is, rapidly decreases) when the catalyst upstream sensor 20 receives the exhaust gas corresponding to the one cylinder. Therefore, the value only in the decreasing side can be used for detecting the rich deviation (rich imbalance determination). In this case, only a downward-sloping area in the graph of FIG. 6 is utilized for detecting the rich deviation. Without being limited to this, only the value in the increasing side can be used for detecting the lean deviation.

Figure 7:
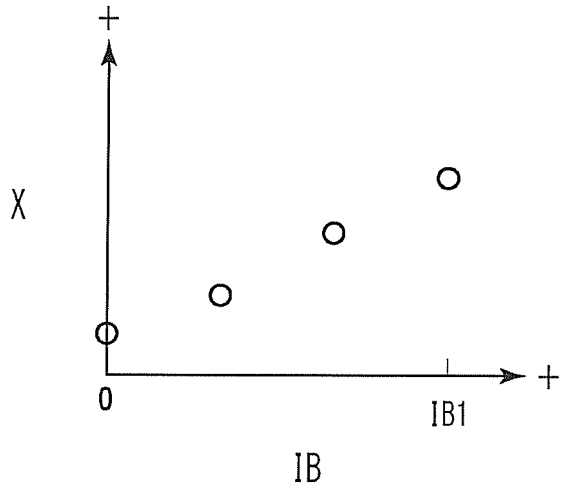
FIG. 7 is a graph showing a relationship between the imbalance ratio and an air-fuel ratio fluctuation parameter.

FIG. 7 shows a relationship between the imbalance ratio IB and the air-fuel ratio fluctuation parameter X. As shown, a strong correlation exists between the imbalance ratio IB and the air-fuel ratio fluctuation parameter X, the air-fuel fluctuation parameter X is increased with the increase of the imbalance ratio IB. IB1 in the drawing indicates a value of the imbalance ratio IB corresponding to a criteria which is a boundary between the normal and the abnormal, corresponds to the predetermined determination value, and is, for example, 60(%).

Hereinafter, there will be described a principle of evaluating the deviation in the air-fuel ratios between the cylinders according to the present embodiment with reference to FIG. 8. In the present embodiment, the deviation in the air-fuel ratio caused by the failure of the intake system or the like, that is, the abnormality in the intake system is also detected by using the air-fuel ratio fluctuation parameter X and changing the injection rates $\alpha$ and $\beta$. A left-hand state I in FIG. 8 corresponds to the case where the injection rate $\alpha$ of the port injector 2 is 40% (=A). Further, a right-hand state II in FIG. 8 corresponds to the case where the injection rate $\alpha$ of the port injector 2 is 80% (=B>A). In the case where the state changes from the state I to the state II, the injection rate $\alpha$ changes from 40% to 80%, the injection rate of the in-cylinder injector 3 decreases from 60% to 20%, and the port injection amount rate increases. A determination value Z is tentatively defined as a value corresponding to the imbalance ratio 20%. An illustrated wave form schematically shows an output wave form of the catalyst upstream sensor 20 in one bank. That is, this case pays attention to only one bank. The detection with respect to the other bank may be carried out simultaneously or at a different timing.

Figure 8:
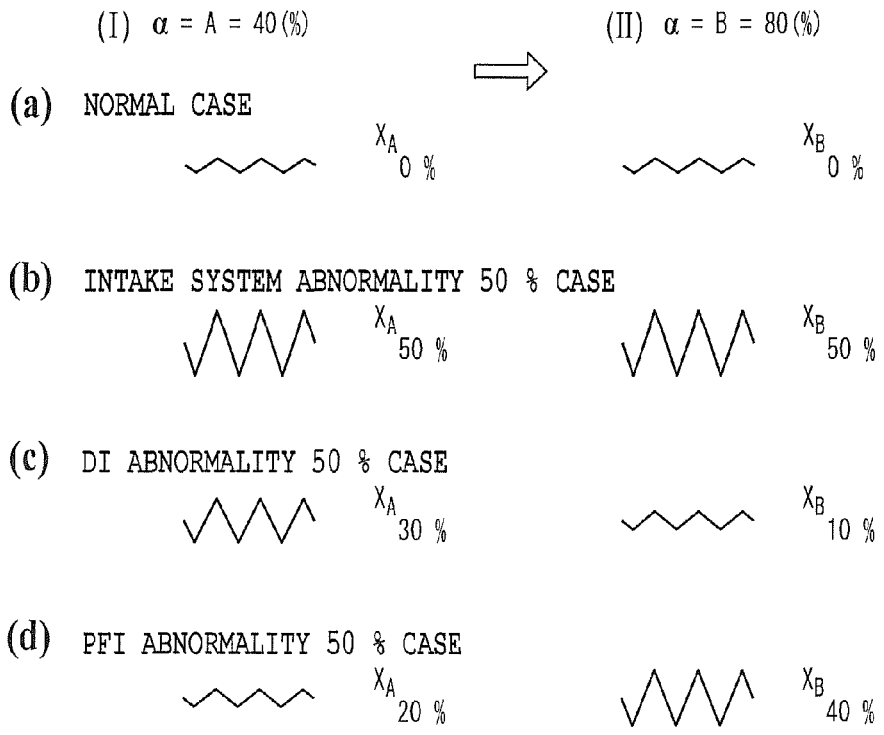
FIG. 8 is view for explaining a principle of abnormality detection.

FIG. 8 (*a*) shows a normal case that any abnormality is not generated in the port injector 2 and the in-cylinder injector 3 in any cylinder, and any abnormality is not generated in the intake system. In this case, an air-fuel ratio fluctuation parameter $X_A$ corresponding to the imbalance ratio 0% can be obtained in the state I, and an air-fuel ratio fluctuation parameter $X_B$ corresponding to the imbalance ratio 0% can be obtained in the state II. A relationship $X_A \leq Z$ and $X_B \leq Z$ holds and this case is determined to be normal.

FIG. 8 (*b*) shows an intake system abnormality 50% case in which any abnormality is not generated in the port injector 2 and the in-cylinder injector 3 in any cylinder, but an abnormality corresponding to an imbalance ratio 50% is generated in the intake system. In this case, the air-fuel ratio fluctuation parameter $X_A$ corresponding to the imbalance ratio 50% can be obtained in the state I, and the air-fuel ratio fluctuation parameter $X_B$ corresponding to the imbalance ratio 50% can be obtained in the state II. A relationship $X_A > Z$ and $X_B > Z$ holds, and in the case of $|X_A - X_B| < Y$ (Y is a predetermined value), that is, in the case where both the air-fuel ratio fluctuation parameters $X_A$ and $X_B$ are large and a difference between these values is within a predetermined range, the intake system is determined to be abnormal. The values of the air-fuel ratio fluctuation parameter X do not differ greatly in the state I and the state II because the port injector 2 and the in-cylinder injector 3 are normal and the air-fuel ratio is not affected by the changes of the injection rates α and β.

FIG. 8 (*c*) shows a DI abnormality 50% case in which an abnormality corresponding to the imbalance ratio 50% is generated in the in-cylinder injector (DI) 3 in one cylinder, any abnormality is not generated in the remaining in-cylinder injectors 3 and port injectors 2, and any abnormality is not generated in the intake system. In this case, the air-fuel ratio fluctuation parameter $X_A$ corresponding to the imbalance ratio 30% can be obtained in the state I. It is because the injection rate of the in-cylinder injector 3 is 60(%) (=100−40), and 50%×60%=30%, that is, the effect of the abnormality in the in-cylinder injector 3 is decreased as a result of the sharing injection. On the other hand, the air-fuel ratio fluctuation parameter $X_B$ corresponding to the imbalance ratio 10% can be obtained in the state II. It is because the injection rate of the in-cylinder injector 3 is 20% (=100−80), and 50%×20%=10%. A relationship $X_A>Z$ and $X_B\leq Z$ holds, and this case is determined to be abnormal in at least any in-cylinder injector.

FIG. 8 (*d*) shows a PFI abnormality 50% case in which an abnormality corresponding to the imbalance ratio 50% is generated in the port injector 2 in one cylinder, any abnormality is not generated in the remaining port injectors 2 and in-cylinder injectors 3, and any abnormality is not generated in the intake system. In this case, the air-fuel ratio fluctuation parameter $X_A$ corresponding to the imbalance ratio 20% can be obtained in the state I. It is because the injection rate of the port injector 2 is 40%, and 50%×40%=20%, that is, the effect of the abnormality in the port injector 2 is decreased as a result of the sharing injection. On the other hand, the air-fuel ratio fluctuation parameter $X_B$ corresponding to the imbalance ratio 40% can be obtained in the state II. It is because the injection rate of the port injector 2 is 80%, and 50%×80%=40%. A relationship $X_A\leq Z$ and $X_B>Z$ holds, and the PFI abnormality is determined in this case.

Figure 9:
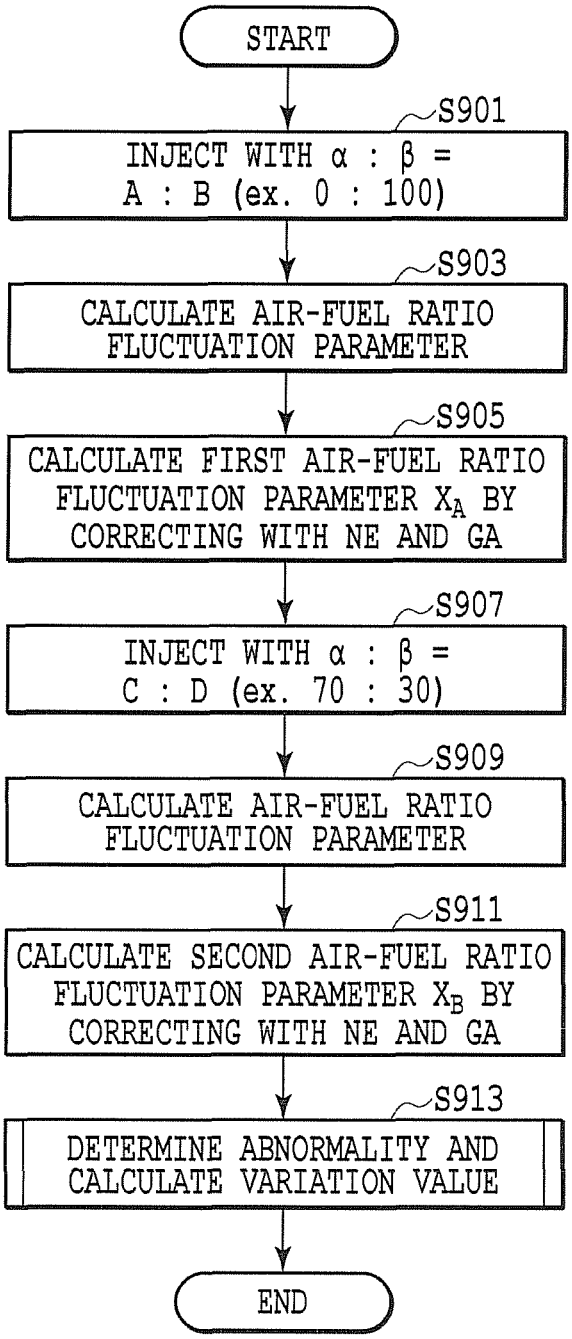
FIG. 9 is a flow chart for calculating a value and the like indicating a degree of variation in the air-fuel ratios between the cylinders, in the first embodiment.

According to the principle mentioned above, in the present embodiment, there is carried out the variation value indicating the variation degree of the air-fuel ratios between the cylinders relating to each of the banks and a mode selection corresponding to its cause. FIG. 9 shows a flow chart of calculating processing of a variation value and the like in the present embodiment. The processing is carried out by the ECU 100 at a predetermined timing. For example, in the case where a predetermined time has passed (an engine warm-up is finished) after starting the engine, an amount of the intake air is within a predetermined range, an engine rotating speed is within a predetermined rotating speed range, and a fuel cut is not carried out, the processing in FIG. 9 is executed. It is preferable that the processing in FIG. 9 is not carried out at a rapid accelerating time and a rapid decelerating time. Particularly, the processing in FIG. 9 is here carried out only one time at an early timing until an ignition is turned off after starting the engine. However, the processing in FIG. 9 may be repeatedly carried out after starting the engine. Furthermore, since a sensor output when the fuel injection ratio is different is employed in the following processing in FIG. 9, the processing in FIG. 9 may be carried out, for example, when the vehicle speed is zero, may not be continuously carried out, or may be intermittently carried out.

First, in the step S901, the ECU 100 sets the injection rates α and β to a first predetermined injection ratio A:B (for example, 0:100), and injects the fuel from the port injector 2 and the in-cylinder injector 3. In the case of this example, the fuel is injected only from the in-cylinder injector 3. Furthermore, in the step S903, the air-fuel ratio fluctuation parameter X is calculated as mentioned above on the basis of the output of the catalyst upstream sensor 20 which is the air-fuel ratio sensor associated with the injection of the fuel at the injection ratio. The step S901 and the step S903 may be continuously carried out, but may be carried out substantially in parallel.

Figure 10:
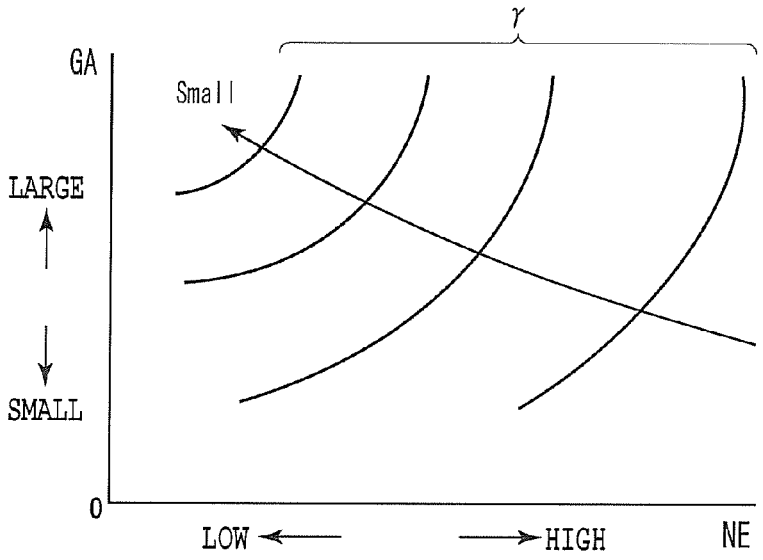
FIG. 10 is a graph for determining a correction coefficient on the basis of an engine rotation speed and an amount of intake air.

In the subsequent step S905, the air-fuel ratio fluctuation parameter X calculated in the step S903 is corrected. The air-fuel ratio fluctuation parameter X calculated in the step S903 is corrected on the basis of average engine rotating speed NE and average intake air amount GA when the fuel injection is carried out with the first predetermined injection ratio in the step S901 (or when the output of the catalyst upstream sensor 20 is acquired for calculating the parameter in the step S903). First, a correction coefficient is calculated by searching mapped data (FIG. 10) on the basis of the engine rotating speed NE and the intake air amount GA. The correction coefficient may be calculated by carrying out a computation on the basis of the data. Generally, the lower the rotation is and the higher the air amount is, the greater the value of the air-fuel ratio fluctuation parameter X is. Accordingly, a correction coefficient γ which becomes smaller toward the lower rotation and the higher air amount is set in the map shown in FIG. 10, so as to cancel the effect of the engine rotating speed NE and the intake air amount GA. Furthermore, the calculated correction coefficient γ is multiplied by the air-fuel ratio fluctuation parameter X which is calculated in the step S903. Accordingly, the effect of the engine rotating speed NE and the intake air amount GA can be removed from the air-fuel ratio fluctuation parameter X. The first air-fuel ratio fluctuation parameter $X_A$ is calculated by being corrected in the above manner, the first air-fuel ratio fluctuation parameter $X_A$ being the corrected air-fuel ratio fluctuation parameter. The first air-fuel ratio fluctuation parameter $X_A$ calculated here corresponds to a first value of the present invention.

Next, the ECU 100 sets the injection rates α and β to a second predetermined injection ratio C:D (for example, 70:30) and injects the fuel from the port injector 2 and the in-cylinder injector 3, in the step S907. Furthermore, in the step S909, the air-fuel ratio fluctuation parameter X is calculated on the basis of the output of the catalyst upstream sensor 20 associated with the injection of the fuel at the injection ratio.

Further, in the step S911, the air-fuel ratio fluctuation parameter calculated in the step S909 is corrected in the same manner as the step S905, by using the correction coefficient (refer to FIG. 10) which is calculated on the basis of the engine rotating speed NE and the intake air amount GA. The second air-fuel ratio fluctuation parameter $X_B$ can be calculated by being corrected in the above manner, the second air-fuel fluctuation parameter $X_B$ being the corrected air-fuel ratio fluctuation parameter. The second air-fuel ratio fluctuation parameter $X_B$ calculated here corresponds to a second value of the present invention. Since the correction in the step S911 is substantially the same as the correction in the step S905, a detailed description thereof will be omitted.

In the case where the first and second air-fuel ratio fluctuation parameters $X_A$ and $X_B$ are calculated as mentioned above, the ECU 100 determines an abnormality and calculates the variation value in the step S913 by using them.

Figure 11:
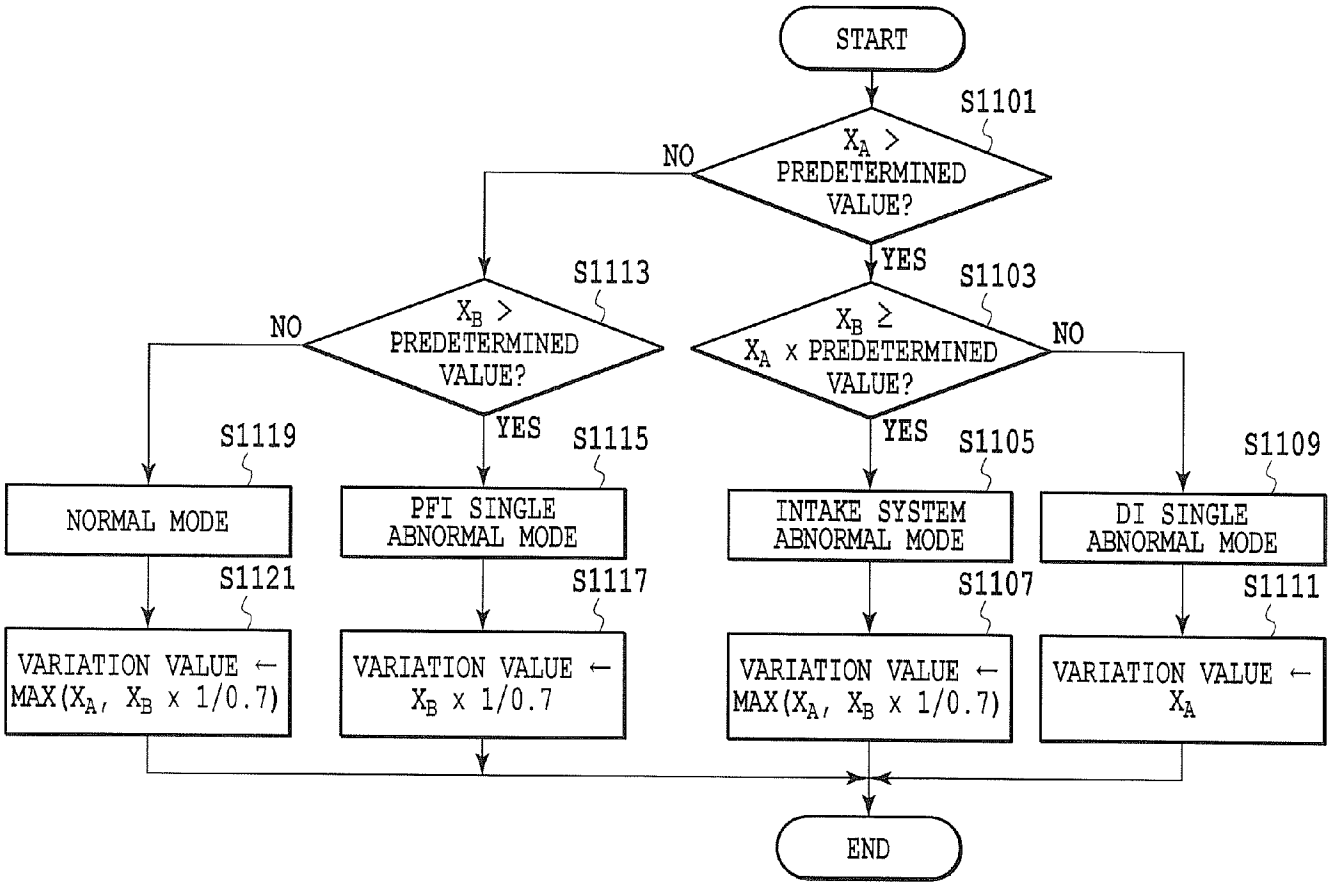
FIG. 11 is a flow chart relating to the flow chart in FIG. 9, and being provided for selecting a mode and calculating a variation value.

A processing procedure for determining the abnormality (selecting the mode) and calculating the variation value in the step S913 is shown in FIG. 11. In FIG. 11, the ECU 100 first determines in the step S1101 whether or not the first air-fuel ratio fluctuation parameter $X_A$ is larger than the predetermined determination value Z. In addition, in the case where a positive determination is made in the step S1101, the ECU 100 compares in the step S1103 the first air-fuel ratio fluctuation parameter $X_A$ with the second air-fuel ratio fluctuation parameter $X_B$. The comparison corresponds to determination whether or not the intake system is abnormal, that is, whether or not the air amount is abnormal. Specifically, it is determined whether or not the second air-fuel ratio fluctuation parameter $X_B$ is equal to or more than a product of the first air-fuel ratio fluctuation parameter $X_A$ and a predetermined value which is previously defined by experiments ($X_A$×predetermined value). That is, the product ($X_A$×predetermined value) is calculated as a lower limit value of a range of a value which the second air-fuel ratio fluctuation parameter $X_B$ can take in the case where the intake system abnormality is generated. The predetermined value is preferably set so as to discriminate the fact that both of the first air-fuel ratio fluctuation parameter $X_A$ and the second air-fuel ratio fluctuation parameter $X_B$ are large, and an absolute value ($|X_A-X_B|$) of a difference between the parameters is within a predetermined range. In the case where the positive determination is made in the step S1103, the intake system is determined to be abnormal (that is, the air amount is determined to be abnormal), and an intake air system abnormal mode is set in the step S1105. Furthermore, a variation value at the time of setting the intake system abnormal mode is calculated in the step S1107. Specifically, among the first air-fuel ratio fluctuation parameter $X_A$ and a value ($X_B$×1/0.7) obtained by normalizing the second air-fuel ratio fluctuation parameter $X_B$ while paying attention to the injection rate of the port injector, the greater one is selected, and is calculated as the variation value serving as the air-fuel ratio fluctuation parameter.

In contrast to this, in the case where a negative determination is made in the step S1103, a DI single abnormal mode is set in the step S1109 by assuming that it is determined that at least any one of the in-cylinder injectors 3 is abnormal. That is, the DI single abnormal mode is a mode relating to the abnormality in at least any one of a plurality of in-cylinder injectors. Furthermore, the first air-fuel ratio fluctuation parameter $X_A$ is calculated and set as a variation value at the time of setting the DI single abnormal mode in the step S1111. On the other hand, in the case where a negative determination is made in the step S1101, it is determined in the step S1113 whether or not the second air-fuel ratio fluctuation parameter $X_B$ is larger than the predetermined determination value Z. Meanwhile, the predetermined determination value in the step S1113 is here the same as the predetermined determination value in the step S1101, but the value may be different. In the case where the positive determination is made in the step S1113, a PFI single abnormal mode is set in the step S1115 by assuming that it is determined that at least any one of the port injectors 2 is abnormal. That is, the PFI single abnormal mode is a mode relating to the abnormality in at least any one of a plurality of port injectors. In addition, a value ($X_B$×1/0.7) obtained by normalizing the second air-fuel ratio fluctuation parameter $X_B$ is calculated and set as a variation value at the time of setting the PFI single abnormal mode in the step S1117.

In contrast to this, in the case where a negative determination is made in the step S1113, a normal mode is set in the step S1119 by assuming that it is determined that any abnormality is not generated in any injector and the intake system is not abnormal. In this case, in the same manner as the step S1107 when the intake system abnormal mode is set, the variation value is calculated and set in the step S1121.

The variation value obtained by the above processing is stored in the memory device, and is used for computation in various controls as the variation values indicating the variation degree in the air-fuel ratios between the cylinders. Before the variation value is calculated as mentioned above, that is, in an initial state, zero is set as the variation value. In the case where the variation value calculated and used during the previous engine operation is stored in the memory device, the variation value can be read and set as an initial value at the engine starting time. In this case, the variation value is updated by a value newly calculated after starting the engine.

Meanwhile, the computing formula and the computing method are only one example, and the other computing formulas and computing methods can also be used.

Hereinbefore, there have been described the calculation of the variation value indicating the degree of the variation in the air-fuel ratios between the cylinders, and the mode determination (selection) corresponding to specifying the cause. Next, there will be described an air-fuel ratio control according to the present first embodiment on the basis of them (using them), that is, a fuel injection control. Meanwhile, the fuel injection control is described below, but the computation is carried out in parallel with the control described below. Furthermore, the value calculated as mentioned above is described as "variation value XI".

In the present first embodiment, a total fuel injection amount injected from the port injector 2 and the in-cylinder injector 3 is determined so as to promote the enriching correction with the increase of the variation degree in the air-fuel ratios between the cylinders on the basis of the variation value XI, and so as to reduce the air-fuel ratio deviation by the deflection of the fuel injection amount from any abnormal one among the port injector 2 and the in-cylinder injector 3 on the basis of the mode selected and determined as above. Hereinafter, there will be described the fuel injection control including the calculation of the fuel injection amount on the basis of flow charts in FIGS. 12 to 15.

Figure 12:
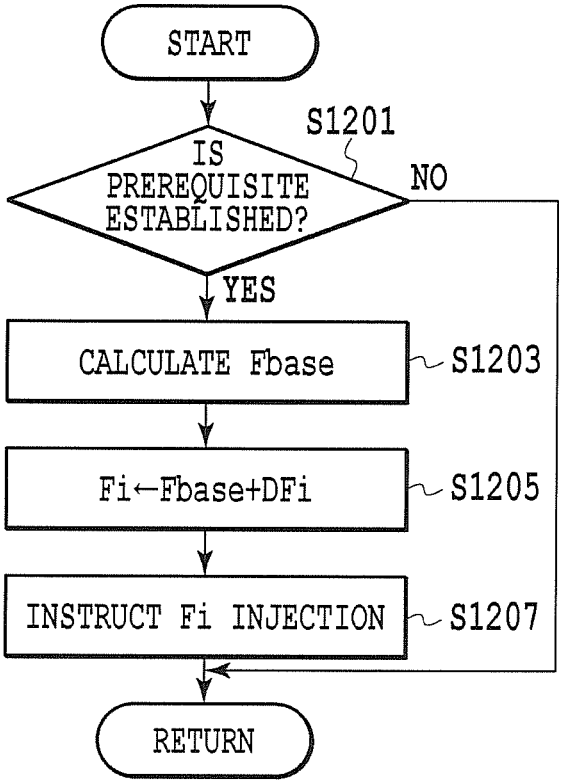
FIG. 12 is a flow chart for controlling a fuel injection in the first embodiment.

FIG. 12 shows a fuel injection control routine, and the fuel injection control routine is repeatedly executed in relation to the cylinder every time a crank angle of an optional cylinder has a predetermined crank angle. The predetermined crank angle is a crank angle of, for example, 90 degrees before an intake top dead center.

In the case where the crank angle of the optional cylinder coincides with the predetermined crank angle, the ECU 100 determines in the step S1201 whether or not a prerequisite is established. Here, the fact that the condition for carrying out the fuel cut is not established is defined as a condition. That is, in the case where the fuel cut is not carried out, a positive determination is made in the step S1201 and the step goes to a step S1203.

In the step S1203, a basic fuel injection amount Fbase is calculated by searching previously set data or carrying out previously set computation on the basis of the output of the air flowmeter 11, the output of the crank angle sensor 22, and the target air-fuel ratio which is previously set to being stoichiometric.

In the subsequent step S1205, the calculated basic fuel injection amount Fbase is corrected by a main feedback amount DFi, and an instruction fuel injection amount Fi is set. Specifically, here, the main feedback amount DFi is added to the basic fuel injection amount Fbase.

The instruction fuel injection amount Fi calculated as mentioned above is set to whole amount or a total amount (a predetermined amount) of the fuel which is injected from the port injector 2 and the in-cylinder injector 3, and in the step S1207, the ECU 100 outputs an injection control signal to the port injector 2 and the in-cylinder injector 3. A predetermined amount of fuel is shared and injected from the port injector 2 and the in-cylinder injector 3, respectively at the injection rates which are set as mentioned above in accordance with the engine operation state at that time. That is, in the case where the fuel injection rate of the port injector 2 is set to 35%, and the fuel injection rate of the in-cylinder injector 3 is set to 65% on the basis of the engine operation state, the fuel corresponding to 35% of the instruction fuel injection amount Fi is injected from the port injector 2, and the remaining fuel is injected from the cylinder injector 3.

Figure 13:
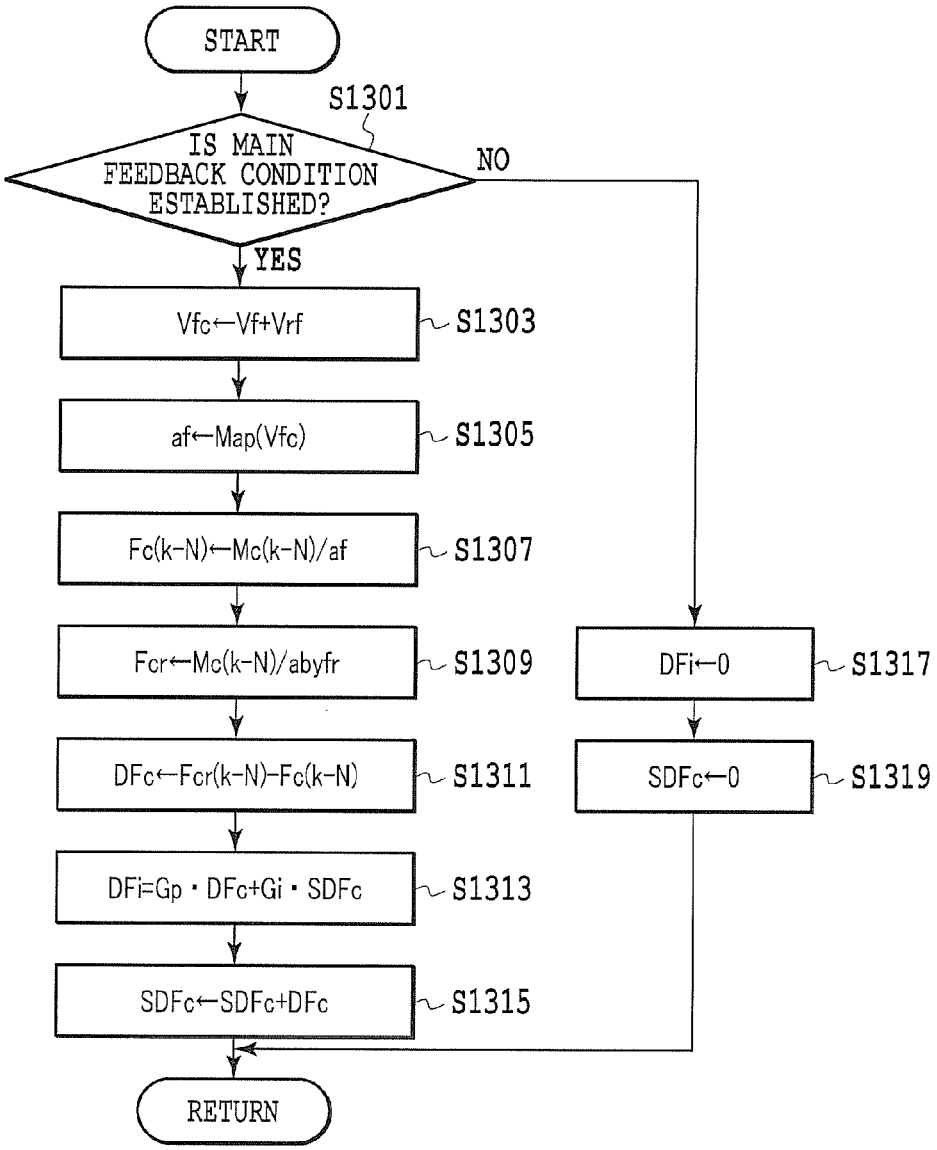
FIG. 13 is a flow chart for calculating a main feedback amount in the first embodiment.

Next, there will be described calculation of the main feedback amount DFi used in the step S1205, on the basis of a flow chart in FIG. 13. The calculation of the main feedback amount DFi substantially corresponds to the main feedback control. Meanwhile, a routine in FIG. 13 is repeatedly executed every elapse of a predetermined time.

In the step S1301 it is determined whether or not a main feedback condition is established. As the main feedback condition, it is defined that the catalyst upstream sensor 20 is activated, that the engine load (for example, the intake air amount) is equal to or less than a predetermined load, and that the fuel is not under cut, and in the case where all of these conditions are established, a positive determination is made in the step S1301.

In the case where the positive determination is made in the step S1301, a feedback controlling output value Vfc is acquired in the step S1303. The feedback controlling output value Vfc is calculated as a sum of an output value Vf of the catalyst upstream sensor 20 and a sub feedback amount Vrf (after correction) which is calculated as mentioned later on the basis of the output of the catalyst downstream sensor 21.

In the subsequent step S1305, a feedback controlling air-fuel ratio of is calculated by applying the data which is mapped as shown in FIG. 2 by the feedback controlling output value Vfc which is calculated in the step S1303.

Furthermore, in the step S1307, a fuel injection amount Fc(k−N) which is an amount of the fuel actually supplied to the combustion chamber at the time point which is N cycles before the time (the current time point) is determined. That is, the fuel injection amount Fc(k−N) is determined by dividing an intake air amount Mc(k−N) at the time point which is N cycles before the current time point by the feedback controlling air-fuel ratio af. As mentioned above, the intake air amount at the time point which is N cycles before the current time point is divided by the feedback controlling air-fuel ratio af, in order to appropriately associate the exhaust gas reaching the catalyst upstream sensor 20 with the detection value.

In the subsequent step S1309, a target fuel supply amount Fcr(k−N) is calculated by dividing the intake air amount Mc(k−N) by a target air-fuel ratio abyfr, the target fuel supply amount Fcr(k−N) being a fuel amount to be supplied to the combustion chamber at the time point which is N cycles before the current time point.

In addition, in the step S1311, a fuel injection amount deviation DFc is calculated by subtracting the fuel injection amount Fc(k−N) from the target fuel supply amount Fcr(k−N). The fuel injection amount deviation DFc is a value indicating excess or deficiency of the fuel supplied at the time point which is N cycles before the current time point.

Furthermore, in the step S1313, the main feedback amount DFi is calculated. The main feedback amount DFi is calculated as a sum of a product between a previously set proportional gain Gp and the fuel injection amount deviation DFc, and a product between a previously set integration gain Gi and an integrated value SDFc of the fuel injection amount deviation.

In the subsequent step S1315, a new integrated value SDFc is calculated by adding the fuel injection amount deviation DFc calculated in the step S1311 to the integrated value SDFc at the time point.

On the other hand, in the case where a negative determination is made in the step S1301, the main feedback amount DFi is set to zero in the step S1317. Furthermore, the integrated value SDFc is set to zero in the step S1319. Accordingly, in the case where the negative determination is made in the step S1301, the correction in the step S1205 of the basic fuel injection amount Fbase by the main feedback amount DFi is not substantially carried out.

Figure 14:
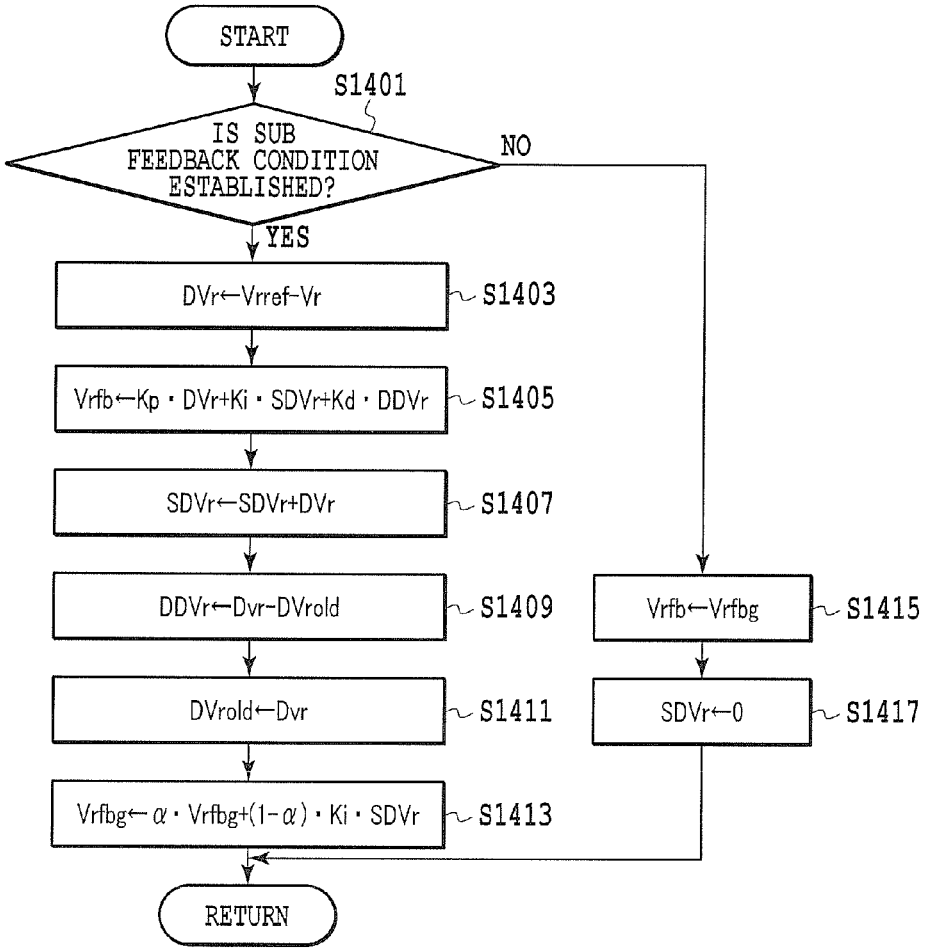
FIG. 14 is a flow chart for calculating a sub feedback amount in the first embodiment.
Figure 15:
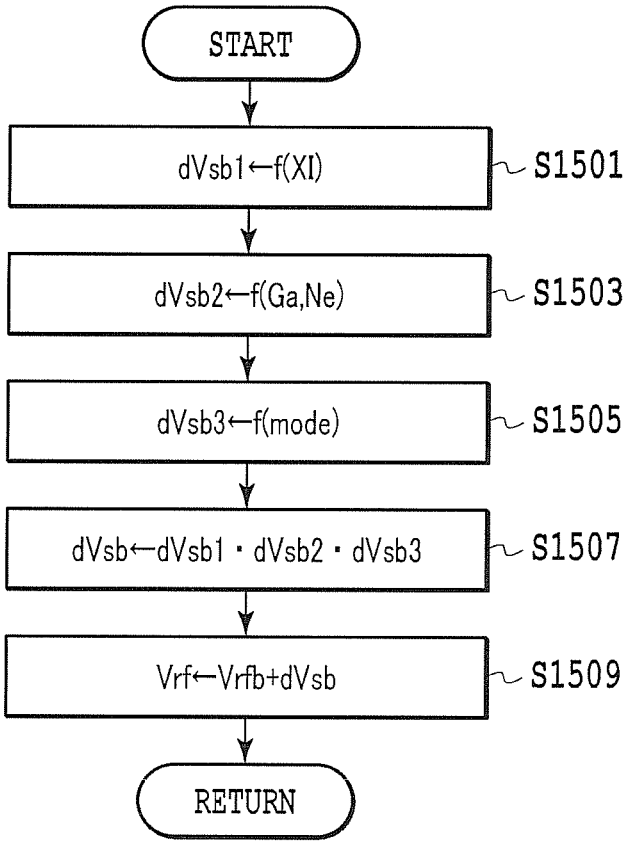
FIG. 15 is a flow chart for correcting the sub feedback amount in the first embodiment.

Next, there will be described calculation of the (corrected) sub feedback amount Vrf which is calculated on the basis of the output of the catalyst downstream sensor 21 and is used in the step S1303, with reference to flow charts in FIGS. 14 and 15. The calculation of the sub feedback amount Vrf substantially corresponds to the sub feedback control. Routines in FIGS. 14 and 15 are repeatedly executed every elapse of a predetermined time.

In the step S1401 it is determined whether or not a sub feedback condition is established. As the sub feedback condition, it is defined that the main feedback condition is established, and that the catalyst downstream sensor 21 is activated, and in the case where all of them are established, a positive determination is made in the step S1401.

In the subsequent step S1403, an output deviation amount DVr which is a difference between a target value Vrref (here, a stoichiometry-corresponding value Vrefr) of the catalyst downstream sensor 21 and an output Vr of the catalyst downstream sensor 21 is calculated.

Furthermore, in the step S1405, a sub feedback amount Vrfb is calculated. The sub feedback amount Vrfb calculated here is corrected according to the flow in FIG. 15. The sub feedback amount Vrfb is calculated by a sum of a product between a previously set proportional gain Kp and the output deviation amount DVr, a product between a previously set integral gain Ki and an integrated value SDVr of the output deviation amount, and a product between a previously set derivative gain Kd and a differential value DDVr of the output deviation amount.

In addition, in the subsequent step S1407, an integrated value SDVr of a new output deviation amount is calculated by adding the output deviation amount DVr calculated in the step S1403 to the integrated value SDVr of the output deviation amount at the time point.

In the subsequent step S1409, a differential value DDVr of a new output deviation amount is calculated by subtracting a previous output deviation amount DVrold corresponding to an output deviation amount calculated at the time of previously executing the present routine from the output deviation amount DVr calculated in the step S1403.

In addition, in the step S1411, the output deviation amount DVr calculated in the step S1403 is stored as the previous output deviation amount DVrold.

In the subsequent step S1413, a sub feedback learning value Vrfbg is updated by using the integrated value SDVr of the output deviation amount ($Vrfbg \leftarrow \alpha \cdot Vrfbg + (1-\alpha) \cdot Ki \cdot SDVr$). The value $\alpha$ is an optional value which is equal to or more than 0 and less than 1.

On the other hand, in the case where the negative determination is made in the step S1401 since the sub feedback condition is not established, a sub feedback learning value Vrfbg is set as the sub feedback amount Vrfb in the step S1415. In addition, in the subsequent step S1417, the integrated value SDVr of the output deviation amount is set to zero.

The sub feedback amount Vrfb calculated in the step S1405 or S1415 as mentioned above is corrected according to a flow in FIG. 15.

First, in the step S1501, a first sub correction coefficient dVsb1 is calculated by carrying out a predetermined computation which is previously set on the basis of "variation value XI" calculated as mentioned above. The first sub correction coefficient dVsb1 is calculated on the basis of the variation value XI so as to be a value further promoting the enriching correction of the air-fuel ratio with the increase of the degree of the variation in the air-fuel ratios between the cylinders. For example, zero is calculated in the case where the degree of the variation in the air-fuel ratios between the cylinders is low and normal, 0.5 is calculated in the case where the degree of the variation in the air-fuel ratios between the cylinders is middle, and 1 is calculated in the case where the degree of the variation in the air-fuel ratios between the cylinders is extremely high, as the first sub correction coefficient dVsb1. In the case where the DI single abnormal mode or the PFI single abnormal mode is set, the first sub correction coefficient dVsb1 is set to the other value than zero.

Next, in the step S1503, a second sub correction coefficient dVsb2 is calculated by performing a predetermined computation which is previously set on the basis of the engine operation state, specifically the intake air amount Ga serving as the engine load and the engine rotating speed Ne. The second sub correction coefficient dVsb2 is calculated, for example, so as to be a value further promoting the enriching of the air-fuel ratio with the increase of the intake air amount. This is because the effect of the high degree of the variation in the air-fuel ratios between the cylinders tends to appear in the output of the catalyst upstream sensor 20 and the like with the increase of the intake air amount. The second sub correction coefficient dVsb2 may be calculated by being computed only on the basis of the intake air amount, or may be calculated on the basis of the other value indicating the engine load in place of the intake air amount or together with the intake air amount. For example, in the case where the intake pressure sensor is provided, the second sub correction coefficient dVsb2 may be calculated on the basis of the output of the sensor.

Next, in the step S1505, a third sub correction coefficient dVsb3 is calculated by performing a previously set computation. The third sub correction coefficient dVsb3 is calculated in accordance with the mode which is set as mentioned above. The mode includes the intake system abnormal mode (S1105), the DI single abnormal mode (S1109), the PFI single abnormal mode (S1115), and the normal mode (S1119). Among them, in the case where the intake system abnormal mode or the normal mode is set, 1 is calculated and set as the third sub correction coefficient dVsb3. Furthermore, in the case where the DI single abnormal mode is set, a value based on the in-cylinder injector injection rate set in accordance with the engine operation state, specifically a value obtained by dividing the in-cylinder injector injection rate by 100 is calculated as the third sub correction coefficient dVsb3. In addition, in the case where the PFI single abnormal mode is set, a value based on the port injector injection rate of the fuel injection ratio set in accordance with the engine operation state, specifically a value obtained by dividing the port injector injection rate by 100 is calculated as the third sub correction coefficient dVsb3.

Furthermore, in the step S1507, a sub correction coefficient dVsb is calculated as a product of the first to third sub correction coefficients dVsb1, dVsb2 and dVsb3 which are calculated from the steps S1501 to S1505.

The calculated sub correction coefficient dVsb is added in the step S1509 to the sub feedback amount Vrfb which is calculated in the step S1405 or the step S1415. The corrected sub feedback amount Vrf is calculated as mentioned above. The corrected sub feedback amount Vrf is used in the step S1303 mentioned above.

As mentioned above, according to the present first embodiment, the sub feedback amount is corrected on the basis of the variation value XI indicating the degree of the variation in the air-fuel ratios between the cylinders and the selection mode, and further on the basis of the engine operation state, the air-fuel ratio feedback control is performed, and the total fuel injection amount is set. Accordingly, the enriching correction is performed in response to the degree of the variation in the air-fuel ratios between the cylinders, and the fuel injection correction is performed in response to the abnormal mode in the case where any of the port injector 2 and the in-cylinder injector 3 is determined to be abnormal. Therefore, it is possible to cause the air-fuel ratio preferably to track the target air-fuel ratio.

Next, there will be described a second embodiment according to the present invention. Hereinafter, there will be described the second embodiment only as to a significantly different point from the first embodiment. Meanwhile, since a configuration of an engine according to the second embodiment is approximately the same as the configuration of the engine 1, a description thereof will be omitted.

Figure 16:
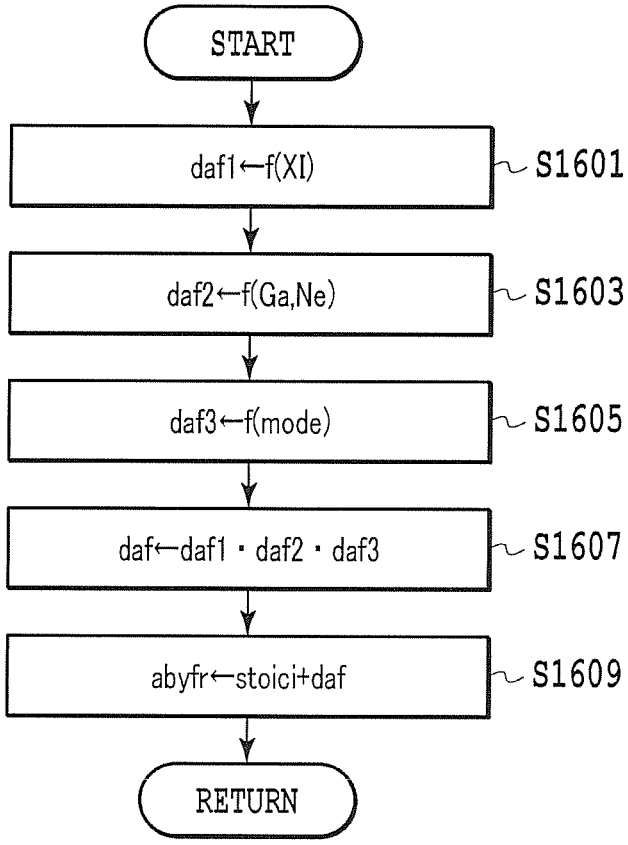
FIG. 16 is a flow chart for correcting a target air-fuel ratio in a second embodiment of the present invention.

In the first embodiment, the sub feedback amount is corrected on the basis of the variation value XI indicating the degree of the variation in the air-fuel ratios between the cylinders and the selected mode, but in the second embodiment, the target air-fuel ratio is corrected on the basis of the variation value XI indicating the degree of the variation in the air-fuel ratios between the cylinders and the selected mode. That is, in the second embodiment, the sub feedback amount Vrfb calculated in the step S1405 or S1415 is not corrected according to the flow in FIG. 15, but is used as it is as the sub feedback amount Vrf in the step S1303. A correction of the target air-fuel ratio will be described on the basis of a flow chart in FIG. 16.

In the step S1601, a first correction coefficient daf1 is calculated on the basis of the variation value XI, a second correction coefficient daf2 in accordance with an engine operation state is calculated in the next step S1603, and a third correction coefficient daf3 in accordance with a selected and set mode is calculated in the step S1605. In addition, a product of the first to third correction coefficients daf1, daf2 and daf3 is calculated as a correction coefficient daf in the step S1607. As a result, the correction coefficient daf is calculated on the basis of the variation value XI indicating the degree of the variation in the air-fuel ratios between the cylinders, the selected mode, and further the engine operation state. The correction coefficient daf is calculated as a value for performing the enriching correction in response to the degree of the variation in the air-fuel ratios between the cylinders, and for changing the fuel injection amount in response to the abnormal mode in the case where either one of the port injector 2 and the in-cylinder injector 3 is determined to be abnormal. Meanwhile, the steps S1601 to S1607 respectively correspond to the steps S1501 to S1507 mentioned above. The correction coefficient calculated in the steps S1601 to S1607 is a value which is suitable for correction of the target air-fuel ratio, and has the tendency mentioned above in relation to the steps S1501 to S1507.

In addition, in the step S1609, the correction coefficient daf is added to a stoichiometry stoici serving as a reference target air-fuel ratio which is basically set here, and a target air-fuel ratio abyfr closer to the rich side (closer to the rich side at a degree according to the selected mode) is calculated and set from the reference target air-fuel ratio, with the increase of the degree of the variation in the air-fuel ratios between the cylinders. That is, a negative value is calculated as the correction coefficient daf so that the target air-fuel ratio abyfr closer to the rich side is calculated from the reference target air-fuel ratio, with the increase of the degree of the variation in the air-fuel ratios between the cylinders. The correction coefficient daf is a product of the first to third correction coefficients daf1, daf2 and daf3, and is set to the negative value, for example, since any one of the first to third correction coefficients is a negative value. Preferably, the first correction coefficient daf1 calculated on the basis of the variation value XI is set to a negative value which is greater in its magnitude, with the increase of the degree of the variation in the air-fuel ratios between the cylinders on the basis of the variation value. Furthermore, the basic fuel injection amount Fbase is calculated in the step S1203 on the basis of the target air-fuel ratio abyfr set as mentioned above.

As mentioned above, the same effect as that of the first embodiment can be also obtained by correcting the target air-fuel ratio. The change described in the first embodiment is allowed in the second embodiment, unless a contradiction arises between them.

Next, there will be described a third embodiment according to the present invention. Hereinafter, there will be described the third embodiment only as to a significantly different point from the first embodiment. The third embodiment described below can be applied in the same manner to the calculation of the second correction coefficient daf2 in the step S1603 according to the second embodiment. Meanwhile, since a configuration of an engine according to the third embodiment is approximately the same as the configuration of the engine 1, a description thereof will be omitted.

Figure 17:
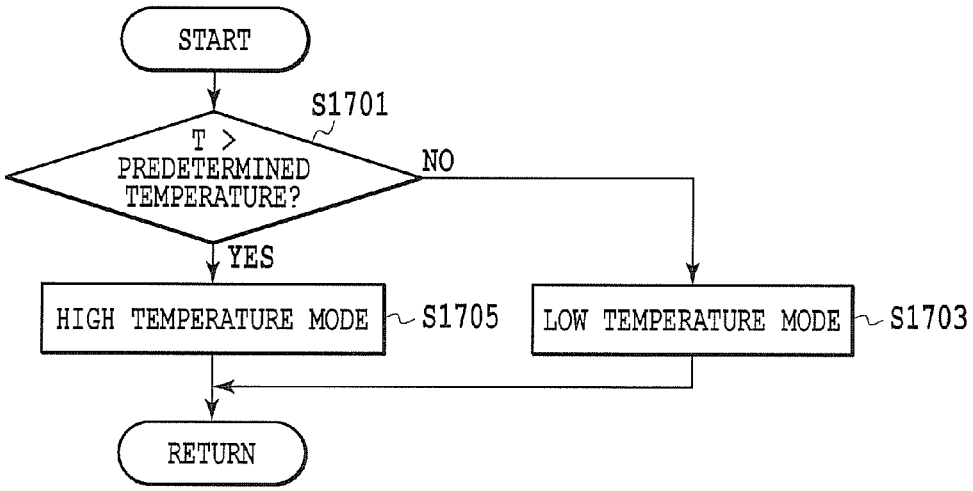
FIG. 17 is a flow chart for setting a second sub correction coefficient calculating mode in a third embodiment of the present invention.

In the third embodiment, computation formulas and data for obtaining the second sub correction coefficient are switched by an engine cooling water temperature. This is because a combustion state of the fuel changes depending on wet and vapor and the like, and therefore a degree of promoting the enriching in the air-fuel ratio control changes in accordance with the changes. There will be described the above matter on the basis of FIG. 17.

In the step S1701 it is determined whether or not a cooling water temperature T detected on the basis of the output of the water temperature sensor 24 is greater than a predetermined temperature. A negative determination is made in the step S1701, a low temperature mode is set in the step S1703, and the computation formula or the data corresponding to the low temperature mode is used for calculating the second sub correction coefficient, in the computation in the step S1503. On the other hand, in the case where a positive determination is made in the step S1701, a high temperature mode is set in the step S1705, and the computation formula or the data corresponding to the high temperature mode is used for calculating the second sub correction coefficient, in the computation in the step S1503.

As mentioned above, it is possible to more preferably carry out the air-fuel ratio control by calculating the second sub correction coefficient in response to the temperature of the engine cooling water, and determining the sub correction coefficient.

Meanwhile, in the present third embodiment, two modes of the high temperature mode and the low temperature mode are switched, but more segmentalized modes may be employed. Furthermore, the computation formula or the data for determining the second sub correction coefficient may be switched in accordance with a time after the engine start, in addition to the temperature of the engine cooling water or in place of the engine cooling water temperature. This is because of the same reason as the switching by the engine cooling water temperature. Meanwhile, the time after the engine start can be measured by a time measuring unit which the ECU 100 takes charge of.

In the engines according to the first to third embodiments described above, the port injector and the in-cylinder injector are provided in each of the cylinders. However, the first to third embodiments can be applied in the same manner, for example, to an engine in which a first in-cylinder injector and a second in-cylinder injector are provided in each of the cylinders. The port injector in each of the embodiments can be replaced by any one of the first in-cylinder injector and the second in-cylinder injector, and the in-cylinder injector in each of the embodiments can be replaced by any other of the first in-cylinder injector and the second in-cylinder injector. Furthermore, the engine according to the embodiment is the gasoline engine, but the present invention is not limited to be used in the engine in which the gasoline is used as the fuel, but can be applied in the same manner to an engine using the other kinds of fuels (including a mixed fuel with the gasoline). The present invention can be applied to various engines in which a plurality of fuel injection valves are provided in each of a plurality of cylinders, and does not limit a cylinder layout type or the like of the applied engine. For example, the present invention can be also applied to an in-line four-cylinder engine.

Furthermore, the value (the first value, the second value or the variation value) indicating the degree of the variation in the air-fuel ratios between the cylinders may employ a value which is calculated according to a different method from the computing method on the basis of the output of the catalyst upstream sensor 20 serving as the air-fuel ratio sensor (the air-fuel ratio detecting device). For example, the first value and the second value may be calculated on the basis of the maximum value and the minimum value of the output of the catalyst upstream sensor 20 in a predetermined period, and the variation value may be calculated. In addition, a value calculated on the basis of a change of a crank angle of the engine may be used as a value indicating the degree of the variation in the air-fuel ratios between the cylinders.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A control device of an internal combustion engine, the control device comprising:

a first fuel injection valve and a second fuel injection valve which are provided in each of a plurality of cylinders of the internal combustion engine; and an electronic control unit operatively connected to the first fuel injection valve, the second fuel injection valve, and the internal combustion engine, the electronic control unit configured to:

inject a predetermined fuel amount of fuel from the first fuel injection valve and the second fuel injection valve, by using an injection ratio which is set in accordance with an engine operation state;

calculate a first value indicating a degree of variation in air-fuel ratios between the cylinders on the basis of a predetermined output of the internal combustion engine associated with the fuel injection from the first fuel injection valve and the second fuel injection valve by using a first predetermined injection ratio;

calculate a second value indicating the degree of variation in the air-fuel ratios between the cylinders on the basis of a predetermined output of the internal combustion engine associated with the fuel injection from the first fuel injection valve and the second fuel injection valve by using a second predetermined injection ratio which is different from the first predetermined injection ratio;

select one mode from a plurality of modes including a first mode relating to abnormality in at least any one of a plurality of first fuel injection valves and a second mode relating to abnormality in at least any one of a plurality of second fuel injection valves, on the basis of the first value and the second value;

calculate a variation value indicating the degree of variation in the air-fuel ratios between the cylinders on the basis of the first value and the second value; and calculate the predetermined fuel amount while performing correction on the basis of the selected mode and the variation value so that the air-fuel ratio tracks a target air-fuel ratio in accordance with outputs of a catalyst upstream sensor and a catalyst downstream sensor which are provided on upstream and downstream sides of a catalyst in an exhaust passage and which respectively generate the outputs corresponding to an amount of oxygen in the exhaust gas, the first fuel injection valve and the second fuel injection valve inject the predetermined fuel amount corrected on the basis of the selected mode and the variation value.

2. The control device of the internal combustion engine according to claim 1, wherein the electronic control unit determines a correction value on the basis of an injection ratio which is set in accordance with an engine operation state, depending on the selected mode in a case where the first mode or the second mode is selected, and calculates the predetermined fuel amount by using the correction value.

3. The control device of the internal combustion engine according to claim 2, wherein the electronic control unit determines the correction value so that the air-fuel ratio has a richer air-fuel ratio than the target air-fuel ratio in line with an increase of the degree of variation in the air-fuel ratios between the cylinders on the basis of the variation value, and calculates the predetermined fuel amount by using the correction value.

4. The control device of the internal combustion engine according to claim 2, wherein the electronic control unit corrects a sub feedback amount which is calculated on the basis of a difference between the output value of the catalyst downstream sensor and the predetermined target value, by using the correction value, and calculates the predetermined fuel amount on the basis of the corrected sub feedback amount.

5. The control device of the internal combustion engine according to claim 3, wherein the electronic control unit corrects a sub feedback amount which is calculated on the basis of a difference between the output value of the catalyst downstream sensor and the predetermined target value, by using the correction value, and calculates the predetermined fuel amount on the basis of the corrected sub feedback amount.

6. The control device of the internal combustion engine according to claim 2, wherein the electronic control unit corrects the target air-fuel ratio by using the correction value, and calculates the predetermined fuel amount on the basis of the corrected target air-fuel ratio.

7. The control device of the internal combustion engine according to claim 3, wherein the electronic control unit corrects the target air-fuel ratio by using the correction value, and calculates the predetermined fuel amount on the basis of the corrected target air-fuel ratio.

8. The control device of the internal combustion engine according to claim 2, wherein the electronic control unit determines the correction value on the basis of an engine operation state, and calculates the predetermined fuel amount by using the correction value.

9. The control device of the internal combustion engine according to claim 3, wherein the electronic control unit determines the correction value on the basis of an engine operation state, and calculates the predetermined fuel amount by using the correction value.

10. The control device of the internal combustion engine according to claim 8, wherein the electronic control unit determines the correction value on the basis of at least one of an engine cooling water temperature and a time from an engine start, and calculates the predetermined fuel amount by using the correction value.

11. The control device of the internal combustion engine according to claim 9, wherein the electronic control unit determines the correction value on the basis of at least one of an engine cooling water temperature and a time from an engine start, and calculates the predetermined fuel amount by using the correction value.

* * * * *